United States Patent [19]

Stahlecker

[11] Patent Number: 4,617,790

[45] Date of Patent: Oct. 21, 1986

[54] PROCESS AND APPARATUS FOR PIECING A YARN AT A SPINNING UNIT OF AN OPEN-END FRICTION SPINNING MACHINE

[75] Inventor: Fritz Stahlecker, Bad Überkingen, Fed. Rep. of Germany

[73] Assignees: Hans Stahlecker; Fritz Stahlecker, both of Bad Überkingen, Fed. Rep. of Germany

[21] Appl. No.: 675,009

[22] Filed: Nov. 26, 1984

[30] Foreign Application Priority Data

Nov. 24, 1983 [DE] Fed. Rep. of Germany ..... 3342472

[51] Int. Cl.[4] ..... D01H 15/00; D01H 7/892

[52] U.S. Cl. ..... 57/263; 57/408; 57/412

[58] Field of Search ..... 57/263, 400, 401, 408, 57/412

[56] References Cited

U.S. PATENT DOCUMENTS

| | | | |
|---|---|---|---|
| 4,055,942 | 11/1977 | Stahlecker | 57/412 X |
| 4,059,946 | 11/1977 | Boettcher et al. | 57/263 |
| 4,102,116 | 7/1978 | Derichs et al. | 57/263 |
| 4,150,530 | 4/1979 | Derichs | 57/408 X |
| 4,156,341 | 5/1979 | Raasch | 57/263 |
| 4,367,623 | 1/1983 | Parker et al. | 57/263 |
| 4,524,578 | 6/1985 | Raasch et al. | 57/263 |

*Primary Examiner*—Donald Watkins

*Attorney, Agent, or Firm*—Barnes & Thornburg

[57] ABSTRACT

In the case of an open-end friction spinning machine having a plurality of spinning units, each having a feeding and opening device with a feeding roller for the feeding of a sliver and with an opening roller for the opening of the fed sliver into individual fibers to be fed to a wedge-shaped gap, an automatic piecing process is provided. In the case of this piecing process, an already spun yarn end is returned into the wedge-shaped gap and, by means of a piecing, is pieced to newly fed fibers. It is provided that the quantity of fibers to be pieced by means of the returned yarn end is for each piecing process adjusted to a constant value by the fact that for each piecing process a sliver end is fed to the opening roller that has the same characteristics.

44 Claims, 20 Drawing Figures

A
B
E
C
F
D
G
I
0
II
a i d k m n b c p f g e h

PROCESS AND APPARATUS FOR PIECING A YARN AT A SPINNING UNIT OF AN OPEN-END FRICTION SPINNING MACHINE

BACKGROUND AND SUMMARY OF THE INVENTION

This invention relates to a process and apparatus for piecing a yarn at a spinning unit of an open-end friction spining machine of the type having a plurality of spinning units. Each spinning unit has two friction rollers that are drivable in the same rotational direction and are arranged next to one another to form a wedge-shaped yarn forming gap. Each spinning unit also includes a feeding and opening device with a feeding roller for the feeding of a sliver and with an opening roller for opening the fed sliver into individual fibers to be fed to the wedge-shaped gap. A suction device is provided for withdrawing the formed yarn in the direction of the wedge-shaped gap. Also provided are a device for winding the yarn onto a spool and a device for monitoring the yarn, which in the case of a yarn breakage, interrupts the feeding of the sliver by interrupting the drive of the feeding device. For the piecing process, a yarn end taken off the spool is returned to the wedge-shaped gap and pieced by means of a yarn piecing to the fibers that were fed by switching the feeding device on again.

An open-end friction spinning unit is known (EP-OS No. 34 427), where a piecing is to take place manually. In the case of this spinning unit, only one of the two rollers is formed as a so-called suction roller having a perforated shell and an interior suction insert aimed at the area of the wedge-shaped gap by means of a suction slot. The other roller has a closed shell surface that is equipped with fittings. In the case of a yarn breakage, the continued feeding of the sliver is interrupted via the yarn guard, while all other drives continue to run at the same speed, i.e. the opening roller, the friction rollers, the withdrawal rollers and the wind-up device. For the piecing process, the spool is lifted off its drive. Then the yarn end is withdrawn from the spool and is cut to length in such a way that the resulting end reaches into the area of the fiber feeding point of the wedge-shaped gap. Subsequently, the yarn end is returned to the area of the wedge-shaped gap, the effect of the suction device being interrupted in a controlled manner so that the yarn end is located in the spinnng unit at a distance from the wedge-shaped gap. Then the suction device is switched on again so that the yarn end arrives in the wedge-shaped gap of the turning friction rollers. Subsequently, the feeding of the sliver is to be switched on again by the switching-on of the drive of the feeding roller and the withdrawal and the winding-up of the yarn is to be switched on again by the lowering of the spool to its withdrawal device. The quality of the piecings with this arrangement depends on the skill of the operating person. But it was found that it is impossible to produce a piecing of the same quality and the same appearance during each piecing process. This unreliability and inconsistency with respect to the quality of the piecing have the result that the spool of yarn produced by means of this device cannot be used immediately during a further processing operation. It is necessary to let the spool of yarn run through a spooling machine and in the process clean out the piecings (if necessary, also other faults in the yarn) and to replace them by another yarn connection, such as a knot. However, such an additional process considerably reduces the cost-effectiveness of friction spinning.

The invention is based on the objective of improving the start spinning at a spinning unit after a yarn breakage in such a way that high-quality piecings are obtained which, with respect to quality, differ so little from the normally spun yarn that they need not be cleaned out so that the produced yarn can be directly processed further with these piecings.

This objective is achieved by providing according to the invention that the quantity of the fibers to be pieced with the returned yarn end is adjusted to a constant value for each start spinning process by feeding to the opening roller for each start spinning process a sliver end that has the same quality.

The invention is based on the consideration that, irrespective of the type of the actual piecing process, it is a basic requirement that the quantity of fibers made available for the piecing process must in each case be exactly the same because otherwise piecings of differing quality will be obtained.

In preferred embodiments of the invention, it is provided that before the actual piecing process, the sliver feeding device is switched on for a predetermined period of time, and within an exactly defined time interval before the start of the actual piecing process, is switched off again, the fibers that were opened up into individual fibers by the opening roller during this process being led out of the spinning unit. This process takes the fact into account that constructively, it is simpler not to interrupt the opening roller in the case of a yarn breakage but to let it continue to run. Only the feeding of the sliver is interrupted which, however, has the result that the end of the sliver, the so-called tuft or fiber beard, is continued to be combed out and thinned out by the opening roller meshing into it, so that as a function of the time interval between a yarn breakage and the connected switching-off of the sliver feeding device and the switching-on again of the sliver feeding device for a piecing process, very different sliver ends or fiber beards may occur containing a differing quantity of fibers. By means of the brief switching-on and switching-off of the fiber feeding in a defined interval before the actual piecing process, it is ensured that for the piecing process, a sliver end is present that has the same characteristics irrespective of the period of time for which the concerned spinning unit was stopped after a yarn breakage until the start of the piecing process.

In a further development of certain preferred embodiments of the invention, it is provided that the fibers opened during the feeding of the sliver that precedes the actual piecing process are fed to the wedge-shaped gap, and, by means of a subsequent cleaning of the wedge-shaped gap, are removed before the start of the actual piecing process. Since a cleaning of the wedge-shaped gap before the actual piecing process is practically always part of the complete piecing program, the additional expenditures are very low.

In a further development of preferred embodiments of the invention, each spinning unit is equipped with an auxiliary suction means leading out into the area of the wedge-shaped gap and acting on the exterior shell surfaces of the friction rollers, said auxiliary suction means being connected to a vacuum source at least during the feeding of the sliver preceding the actual piecing process. By means of this auxiliary suction means, a cleaning process can be carried out in a simple way during which the fibers are removed which were fed to the wedge-shaped gap during the switching-on of the feeding device for the purpose of the preparation of the fiber beard or tuft. If necessary, it is also contemplated by means of this cleaning to remove the dirt and fiber residues which remain in the area of the wedge-shaped gap after the yarn breakage and which are twisted into a cocoon/caterpillar shape. In order to facilitate the cleaning by means of the auxiliary suction means, it is advantageous to interrupt the drive of the rollers at least during the feeding of the sliver preceding the actual piecing process. For the same purpose, it is advantageous to switch off or throttle the effect of the suction device at least during the feeding of the sliver preceding the actual piecing process. This cancels or at least reduces the forces holding the fibers and the yarn in the wedge-shaped gap during the spinning so that the fibers and the dirt can be removed relatively easily. In order to detach the fibers or fiber residues and dirt from the area of the wedge-shaped gap, it is provided in another development of the invention that the suction device, while the auxiliary suction means is switched on, is connected at least for a short time to a high pressure source. This generates an air current coming from the inside of the rollers and going in the direction of the auxiliary suction means by means of which a very effective cleaning can be carried out.

In a further development of preferred embodiments of the invention, it is provided that the spinning units are equipped with a removable covering for the wedge-shaped gap, that a cleaning device is provided that can be applied to the exposed wedge-shaped gap, and that the cleaning device is applied to the wedge-shaped gap after or during the feeding of the sliver preceding the actual piecing process. By means of this additional cleaning device which may also contain mechanical cleaning means, a very effective cleaning is made possible, removing at the same time also from the area of the wedge-shaped gap the fibers opened during the switching-on of the feeding device of the sliver preceding the piecing process and transported into the area of the wedge-shaped gap.

In a further development of preferred embodiments of the invention, it is provided that a fiber feeding channel connecting the opening roller of each spinning unit with the wedge-shaped gap can be exposed at least partially, and that during the feeding of the sliver preceding the actual piecing process, a device for receiving the individual fibers is applied to the at last partially exposed fiber feeding channel of each spinning unit. In the case of this arrangement, the fibers that were made into individual fibers during the preparation of the sliver, do not even reach the area of the wedge-shaped gap but are intercepted beforehand and led away. Another cleaning of the wedge-shaped gap is therefore not necessary.

In a further development of preferred embodiments of the invention, it is provided that the auxiliary suction means of each spinning unit opens out into a fiber feeding channel connecting the opening roller with the wedge-shaped gap, and that the fiber feeding channel is closed behind the mouth of the auxiliary suction means during the feeding of the sliver preceding the actual piecing process. In this manner, a type of short or short-cut is produced between the auxiliary suction means and the opening roller, by means of which the fibers made into individual fibers during the preparation of the fiber beard are led off directly without arriving in the wedge-shaped gap. In this case, the spinning unit itself does not have to be opened because only a direct connection is produced between the auxiliary suction means and the fiber feeding channel.

In a further development of the invention, it is provided that before the actual piecing process, the feeding of the sliver is switched on for a certain time period and is subsequently switched off again, the end of the sliver that is present after the switching off being moved back from the area of the opening roller and the fibers that were made into individual fibers by the opening roller before the actual piecing process being led out of the spinning unit. By means of the moving-back of the sliver after the preparation of the fiber beard, this fiber beard is disengaged from the opening rollers so that, on the one hand, it receives a certain shape and is, on the other hand, no longer combed out. This measure is advantageous when a relatively long period of time, for example ten seconds or more, passes between the preparation of the end of the sliver, the so-called fiber beard, and the actual piecing process. It is then prevented that during this time period fibers are still combed out and transported into the area of the wedge-shaped gap which could interfere with the piecing process.

In a further development of preferred embodiments of the invention, it is provided that the yarn withdrawal device and/or the feeding device of the fibers and/or the drive of the rollers, during the production of the piecing, are temporarily operated at speeds that are reduced in comparison to the operational speed, the speeds being coordinated to one another in such a way that a yarn count is spun which corresponds to the yarn count spun at operational speeds. In this case, a special advantage of friction spinning is utilized, where it is possible to spin the same yarn count even when the speeds vary. Because of the reduction of the speeds, longer time periods are made available for the individual process steps of the actual piecing process so that these can be proportioned and adapted to one another more precisely. In this case, it is advantageous that the speeds are increased to the operational speeds in such a way that also during the increase, the same yarn count is spun. Thus a uniform yarn is obtained so that the quality of the spool is not impaired.

In a further development of preferred emoodiments of the invention, in the case of an open-end friction spinning machine having a plurality of spinning units, a servicing apparatus is provided that can be moved along the machine and can in each case be applied to a spinning unit, said servicing apparatus being equipped with means for carrying out a piecing process at a spinning unit. In especially preferred embodiments the servicing apparatus contains means for actuating the feeding device that can be switched on before the actual piecing process for an indicated period of time and are switched off again for an exactly defined time period until the actual piecing process. This results, on the one hand, in a reduction of the manufacturing expenditures for an automatic piecing since the means for carrying out the individual process steps in most cases exist only once, namely in the servicing apparatus and not at each spinning-unit. On the other hand, the advantage is achieved that the individual process steps are carried out by always the same means so that it is ensured that the same conditions exist and can always be reproduced. This applies in particular also to the means by which the fiber beard is prepared in such a way that it has the same characteristics before each piecing process.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
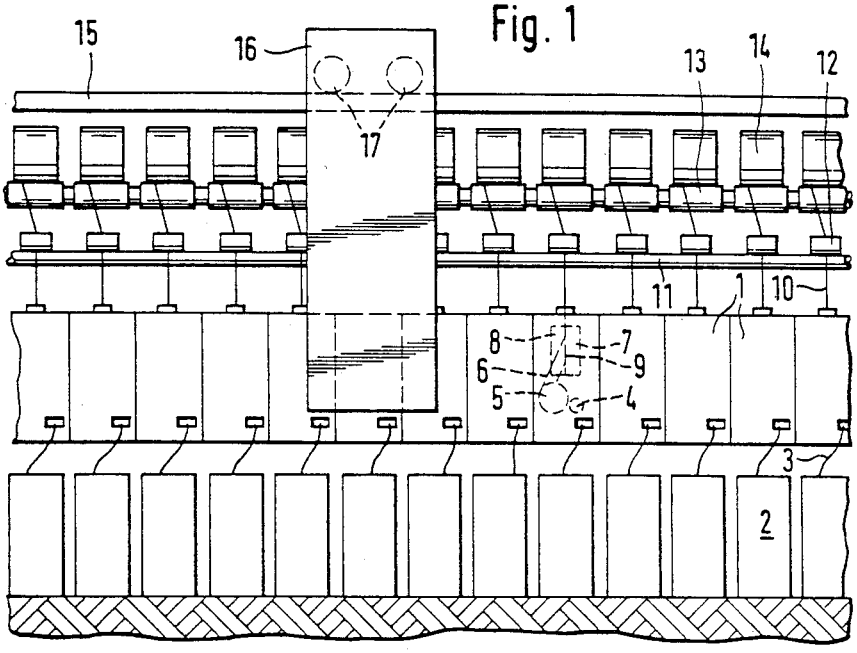
FIG. 1 is a front view of a part of an open-end friction spinning machine having a plurality of spinning units arranged next to one another and a movable servicing unit constructed in accordance with a preferred embodiment of the present invention.

The open-end friction spinning machine partially shown in FIG. 1 has a plurality of spinning units 1 arranged next to one another. Respective cans 2 supply sliver 3 to each spinning unit 1. Via a feeding roller 4 interacting with a feeding table 55 (also see FIG. 4), sliver 3 is fed to a rapidly turning opening roller 5 which separates the sliver 3 into individual fibers which are fed via a fiber feeding channel 6 to a wedge-shaped gap 9 formed by two friction rollers 7 and 8 arranged next to one another and drivable in the same rotational direction. These parts are outlined in dashed lines for one spinning unit 1 in FIG. 1, it being understood that each spinning unit has corresponding parts. The yarn 10 spun in the spinning unit 1 is withdrawn by a withdrawal device formed by a driven withdrawal cylinder 11 extending in the longitudinal direction of the machine and respective pressure rollers 12 which are in each case applied to one spinning unit 1. The withdrawn yarn 10 is then wound onto a wind-up spool 14 resting on and being driven by a grooved drum 13. Above the spinning units 1, the open-end friction spinning machine is equipped with driving rails 15 on which the automatic servicing apparatus 16 can be moved by means of running wheels 17 of which at least one is driven.

Figure 2:
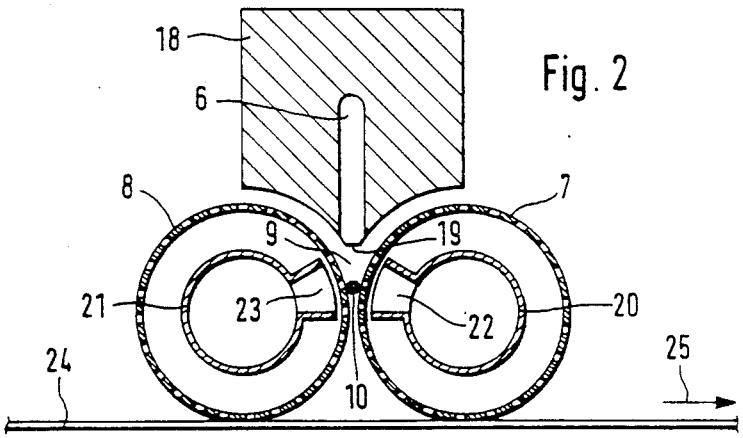
FIG. 2 is an enlarged cross-section through a spinning unit in the area of two friction rollers forming a wedge-shaped yarn forming gap of the type contemplated by the present invention.

The yarn 10 (FIG. 2) is formed in the tapering area of the wedge-shaped gap 9 of the friction rollers 7 and 8 that are driven in the same rotational direction. The rollers 7 and 8 which are arranged in parallel at a short distance from one another are driven by a tangential belt 24 extending in the longitudinal direction of the machine in the direction of Arrow 25, said belt 24 running along against the exterior shell surfaces of both rollers 7 and 8 and driving these in the same rotational direction. The tangential belt 24 drives the rollers 7 and 8 of all spinning units 1 of one side of the machine. The shell surfaces of the rollers 7 and 8 are perforated.

On the inside of tne two rollers 7 and 8, suction inserts 20 and 21 are arranged in each case which have suction slots 22 and 23 that are open in the direction of the wedge-shaped gap 9. The suction slots 22 and 23 are delimited by webs projecting up to close to the inside walls of the shell surfaces of the rollers 7 and 8. A vacuum source is connected to the suction inserts 20 and 21 so that a suction air current is created in the area of the wedge-shaped gap 9 for holding the forming yarn 10 in this area for feeding of the fibers from the fiber feeding channel 4. This fiber feeding channel 6 has a flat, rectangular cross-section. In a slot shaped manner channel 6 opens to a mouth 19 extending in the longitudinal direction of the wedge-shaped gap 9 and at a short distance from this gap.

Figure 3:
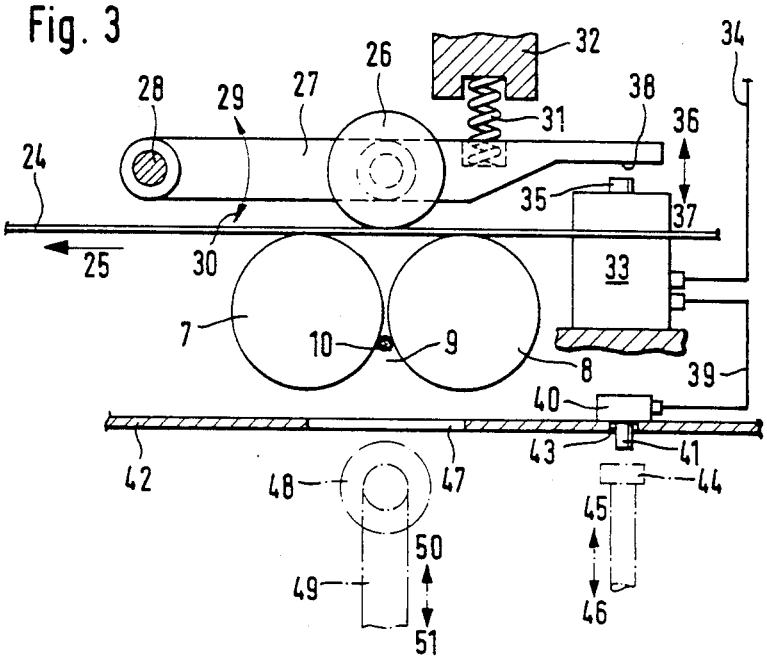
FIG. 3 is a schematic view which shows the means for driving the friction rollers of a spinning unit and outlines the means of a servicing apparatus by which the drive of the rollers can be interrupted and taken over by an auxiliary drive of the servicing apparatus, according to a preferred embodiment of the invention.

In the normal spinning operation, the tangential belt 24 (FIG. 3), is pressed by means of a tension pulley 26 against the two exterior shell surfaces of the rollers 7 and 8. The tension pulley 26 has a shaft which is parallel to that of the rollers 7 and 8 and is arranged in the center between the two rollers 7 and 8. Pulley 26 is disposed on a pivotal lever 27 which can be pivoted around a pivotal shaft 28 that is parallel to its axis of rotation corresponding to the Arrows 29 and 30. In the operating position, the tension pulley 26 is loaded by means of the pressure spring 31 applied to the pivotal lever 27, said pressure spring 31 supporting itself at a part 32 of the machine frame.

A magnet 33 is applied to the pivotal lever 27, said magnet, via a line 34, being connected to a yarn guard that is not shown. By actuating the electromagnet 33 via the yarn guard, the tappet 35 is moved out in the direction of Arrow 36, placing itself at a pressure surface 38 of the pivotal lever 27 and swivelling it, together with the tension pulley 26, away from the tangential belt 24 in the direction of Arrow 29. By means of guiding elements that are not shown, the moving path of the tangential belt 24 may be selected in such a way that, after the swivelling-away of the tension pulley 26, it detaches itself from the shell surfaces of the rollers 7 and 8. According to other contemplated arrangements, a lift-off roll can also be mounted at the pivotal lever 27 that is located on the side of the tangential belt facing the rollers 7 and 8, by means of which, when the pivotal lever 27 is pivoted in the direction of Arrow 29, the tangential belt 24 is detached reliably from the rollers 7 and 8. When the tappet 35 is pulled oack again corresponding to the direction of Arrow 37, the pressure spring 31 applies the tension pulley 26 to the tangential belt 24. Tne tappet 35 will then be disposed at a distance from the pressure surface 38.

For the electromagnet 33, a second actuation is provided by means of a switch 40 which is mounted at a cover 42 of the spinning unit 1 in such a way that its thrust piece 41 projects out of the cover through an opening 43. The switch 40, via a line 39, is connected with the electromagnet 33. Via this switch 40, the electromagnet 33 can be switched through the movable servicing apparatus 16 which is equipped with a pressure rod 44 that can be moved out corresponding to the direction of the Arrows 45 and 46, said pressure rod 44 actuating the thrust piece 41 of the switch 40.

The servicing apparatus 16 is equipped with an auxiliary drive in the form of a friction wheel 48 which can be applied through a recess 47 of the covering 42 simultaneously to the two shell surfaces of the rollers 7 and 8 in the direction of the Arrows 50 and 51. The friction wheel 48, which is disposed on a lever 49, is connected to a driving motor that can be accelerated preferably continuously from a slow speed to the normal spinning operational speed of the rollers 7 and 8.

Figure 4:
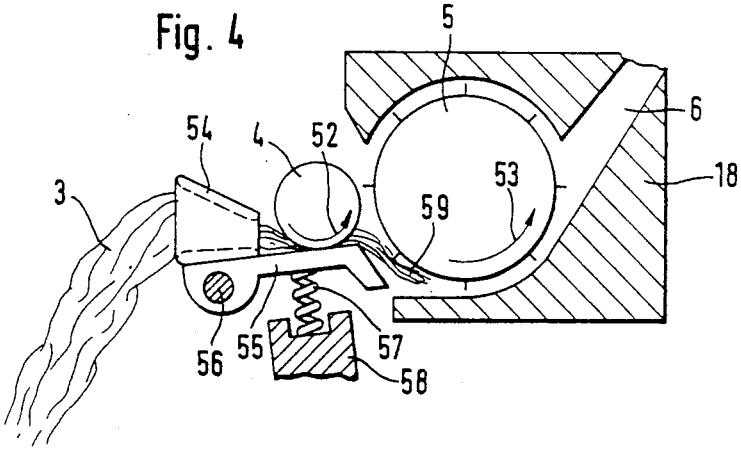
FIG. 4 is a sectional schematic view through a feeding and opening device of a spinning unit of the type contemplated by the present invention.

FIG. 4, in diagram form, shows a typical feeding and opening device containing a feeding hopper 54 for guiding sliver 3 to between the feeding roller 4, which at feeding speed is driven in the direction of arow 52, and a feeding table 55. The feeding table 55 is pivotable around a shaft 56 which is parallel to the feeding roller 4 and is pressed against the feeding roller 4 by means of a pressure spring 57 supporting itself at a holder 58.

The feeding table 55 and the feeding roller 4 form a nip line. The sliver 3 that is held wedged between the feeding roller 4 and the feeding table 55 is offered to the circumference of the opening roller 5 rotating at a consideraoly higher speed, for example, 5,000 to 7,000 $min^{-1}$ (revolution per minute). The circumference of the opening roller 5 rotating in the direction of the Arrow 53 is provided with a fitting of needles or saw teeth which combs out the end of the sliver 3/fiber beard 59 and in the process divides the sliver 3 into individual fibers. In the normal operation, i.e., when the feeding roller 4 and the opening roller 5 are turning, it will be found that the fiber beard 59 has a constant shape, i.e., a constant density and a constant length. When the feeding roller 4 is stopped, which takes place via a signal initiated by the yarn guard 67 (FIG. 5), the continued feeding of the sliver 3 is immediately interrupted. However, the opening roller 5 which continues to turn and its teeth/fitting still mesh with the fiber beard 59 so that the same is continued to be combed out until, with respect to density and length, the beard is reduced to the extent that practically no more fibers mesh with the fitting of the opening roller 5. Depending on what time interval has elapsed between the stopping of the feeding roller 4 and a restarting, the fiber beard 59 can therefore have very different shapes and the quantity of fibers combed out by the opening roller 5 fed to the wedge-shaped gap 9 via the fiber feeding channel 6 also changes correspondingly, when the feeding roller 5 is switched on again. In order to achieve that such a difference with respect to the number of fibers fed at the start of a piecing process do not occur, the sliver end, the so called fiber beard, is prepared before each piecing process, preferably in such a way that for the piecing, a fiber beard 59 is present which, with respect to its quality, largely corresponds to the quality of the operationally produced fiber beard. For this purpose, it is advantageously provided that the feeding roller 4, while the opening roller 5 is turning, is switched on for a short time which is selected to be at least so long that after it, the operational quality of the fiber beard 59 is definitely obtained. Then the feeding roller 4 is stopped again.

The fibers which were combed out by the opening roller 5 during the preparation of the fiber beard 59 are led out of the spinning unit 1, as will be explained later. They are not used for forming the yarn or the piecing. Tne actual piecing process during which the feeding roller 4 is switched on again, starts after an exactly defined time interval from the time the feeding roller was switched on again to form the fiber beard. In this case, it is important that the time period between the switching-on of the feeding and the start of the actual piecing process is exactly defined and maintained because it will then be ensured that a uniform number of fibers will always be available for the piecing process. It is not that important how long this time period is, because the maintaining of the exact number of fibers is ensured solely on the basis of the exact determination of the time period.

As will be explained later, the piecing process is carried out by the movable servicing apparatus 16. This servicing apparatus 16 also controls the drive of the feeding roller 4 during the preparation of the fiber beard 59. In preferred embodiments this control of feeding roller 4 is effected by acting upon the yarn guard 67 (FIG. 5) which then, despite a yarn break, is subjected to the simulation of the presence of a yarn so that for that reason, the feeding roller 4 is switched on again. However, it is advantageous according to other especially preferred embodiments that this control of feeding roller 4 takes place via an auxiliary drive 70 (FIG. 5) that can be connected with the feeding roller 4, by means of which the feeding roller 4 can be controlled at a desired speed ratio during the piecing process until it is accelerated to its operational speed. It is advantageous to also utilize this auxiliary drive 70 in order to carry out the feeding of the sliver 3 during the preparation of the fiber beard 59. Especially when an extended time period must elapse between the preparation of the fiber beard 59 and the later piecing process, it is preferably provided that the feeding roller 4 is reversed against its operational rotating direction (direction of the Arrow 52), via the auxiliary drive so that as the result, the fiber beard 59 is withdrawn from the opening roller 5. A further combing-out of the fiber beard will then be reliably prevented also during an extended stoppage.

Figure 5:
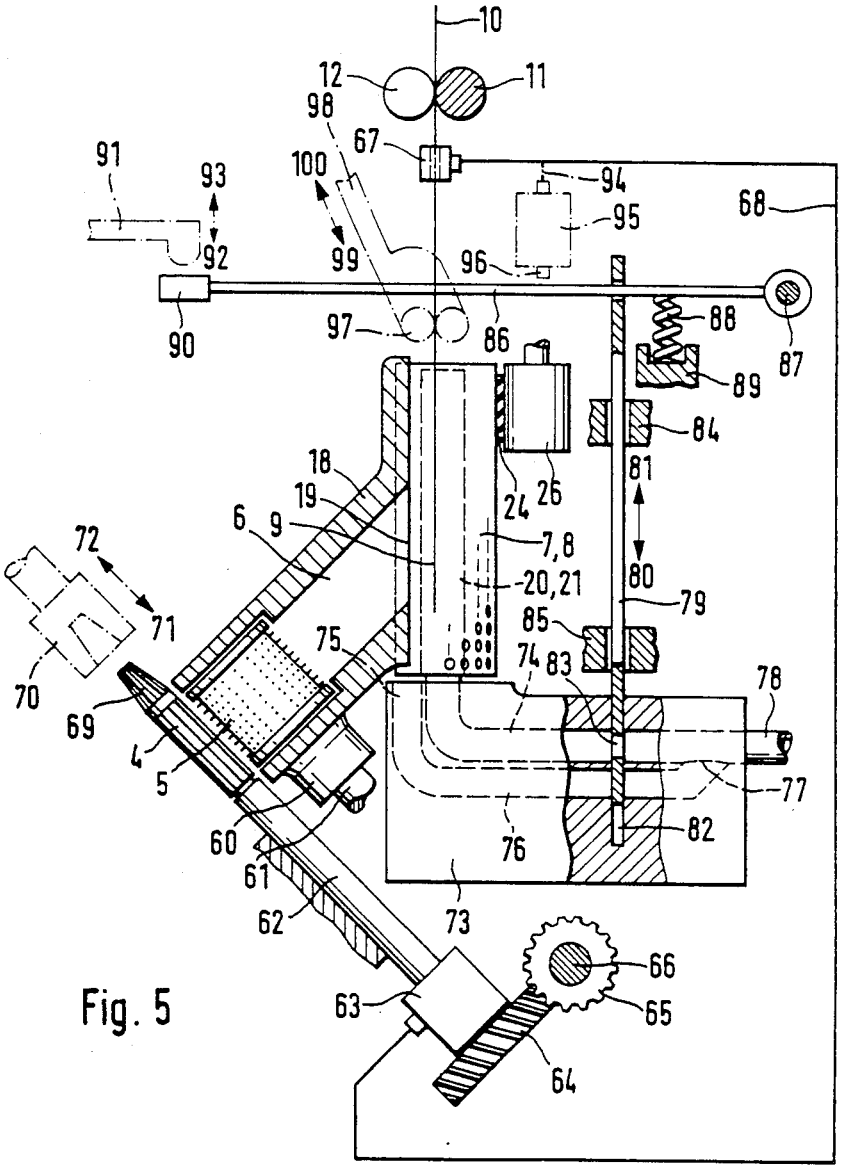
FIG. 5 is a partial sectional lateral schematic view of an individual spinning unit and parts of a servicing apparatus constructed in accordance with a preferred embodiment of the invention.

In the case of the embodiment according to FIG. 5, which shows a partially sectional lateral schematic view of an individual spinning unit 1, partial housing 18 also serves as the bearing housing for the opening roller 5. The partial housing 18 is equipped with a preferably flange-mounted bearing housing 60 for the opening roller 5, the shaft 61 of which protrudes out of the bearing housing 60 and is driven via a tangential belt running through in the longitudinal direction of the machine in a manner that is not shown in further detail. The feeding roller 4 is disposed in a stationarily held bearing pipe 62 with a shaft and at its free end is equipped with a toothed wheel 64 meshing with a corresponding toothed wheel 65 which is driven by a shaft 66 running through in the longitudinal direction of the machine. An electromagnetic coupling 63 is arranged between the shaft of the feeding roller 4 and the toothed wheel 64, which coupling 63 is switched by the yarn guard 67 with which it is connected via the line 68. The end of the feeding roller protruding from the front side of the spinning unit 1 is equipped with a conical driving pinion 69 onto which an auxiliary drive 70 of the servicing apparatus 16 can be selectively fitted via a corresponding recess. Auxiliary drive 70 can be moved in and out of the servicing apparatus 16 in the direction depiected by Arrows 71 and 72. The auxiliary drive 70 is connected in a manner that is not shown in detail to an electric motor that can be accelerated continuously from a low speed to an operational feeding speed and, as necessary, can also be switched in its rotational direction.

The tube-shaped suction inserts 20 and 21, on which the shell surfaces of the rollers 7 and 8 are disposed preferably directly via roller bearings, are connected via ducts 74 to a joint suction pipe 78 leading to a vacuum source. A valve slide 79 is provided which is guided in two guides 84 and 85 so that it can be slid corresponding to the Arrows 80 and 81 and control the flow insid the joint suction pipe 78. The valve slide 79 is provided with a through-bore 83 which selectively closes or exposes the connection between the vacuum pipe 78 and tne ducts 74. Another duct 76 is also connected to the vacuum pipe 78 via a branching 77 which is arranged with a mouth 75 extending adjacent the wedge-shaped gap 9 on the side that is opposite the withdrawal device 11, 12. The valve slide 79 can be slid in the guide 82 of the switch-off device 73 in such a way that the through-opening 83 can be brought into the range of the duct 76 so that the mouth 75, serving as the auxiliary suction means, is connected to the vacuum source. The valve slide 79 can therefore be adjusted in such a way that selectively the suction inserts 20 and 21, i.e., the operational suction device, or the mouth 75, i.e., the auxiliary suction means, are connected to the vacuum source.

The valve slide 79 is held in the desired position by means of an actuating rod 86 which penetrates it in a bore. The actuating rod 86 can be pivoted around a pivotal shaft 87 extending transversely to the sliding direction (Arrows 80 and 81). The actuating rod 86 is also held in the operational position by means of a pressure spring 88 supporting itself against a holder 89, in which it rests against a limit stop. This limit stop, in the case of the shown embodiment, is in the form of an operating magnet 95 (shown in dash-dotted lines) which, with its tappet 96, is opposite the actuating rod 86, and which, via an electric line 94, is connected with the yarn guard 67. By means of this operating magnet 95, it can be provided in the case of a yarn breakage that the valve slide 79 is switched automatically so that the suction inserts 20 and 21 are separated from the vacuum source and the auxiliary suction means 75 is connected to the vacuum source. Instead of the operating magnet 95, a stationary limit stop may also be provided according to other contemplated embodiments.

The actuating rod 86 is also equipped with an actuating member 90 projecting out of the spinning unit 1 to the operating slide, an actuating lever 91 of the servicing apparatus 16 being able to be applied to said actuating member 90 corresponding to the direction of the Arrows 92 and 93. Via the actuating lever 91, the servicing apparatus 16 can therefore selectively connect the suction device (suction inserts 20 and 21) and the auxiliary suction means (mouth 75) to the vacuum source. It is also contemplated to provide, instead of the shown valve slide 79, a multiple way valve in the pipe leading to the suction inserts 20 and 21 and to the mouth 75 which is then actuated directly electromagnetically. For this purpose, a switch may also be provided that can be actuated by the servicing apparatus 16 and that is arranged in an area that is accessible to the servicing apparatus 16. This multi way valve may also provide that the suction inserts 20 and 21 are, as required, also connected with a vacuum and compressed air source so that compressed air can be blown out from the inside to the outside through the wedge-shaped gap via the suction inserts 20 and 21, in particular in order to achieve an intensive cleaning.

In FIG. 5, a pair of auxiliary withdrawal rollers 97 of the servicing apparatus 16 is shown in a dash-dotted manner, said pair being arranged on a rod 98 and being selectively movable to adjacent the rollers 7 and 8 in the area of the discharge of the yarn in directions corresponding to Arrows 99 and 100. By means of the pair of auxiliary rollers 97, a yarn end that was previously taken off by the wind-up spool that is not shown can be returned to the spinning unit 1, while during the return, the suction inserts 20 and 21 are advantageously separated from the vacuum source and the auxiliary suction means 75 is connected to the vacuum source. This makes it possible to suck the yarn end into the spinning unit 1 by means of of the auxiliary suction means 75 and advantageously also into the duct 76. In the case of the actual piecing process, the auxiliary withdrawal rollers 97 cause the yarn withdrawal which at first takes place preferably at a reduced speed, the yarn being led to a wind-up device of the servicing apparatus 16, said wind-up device, during the piecing process, first driving the wind-up spool which, during this time, is lifted off the grooved drum 13 of the respective spinning unit 1.

Figure 6:
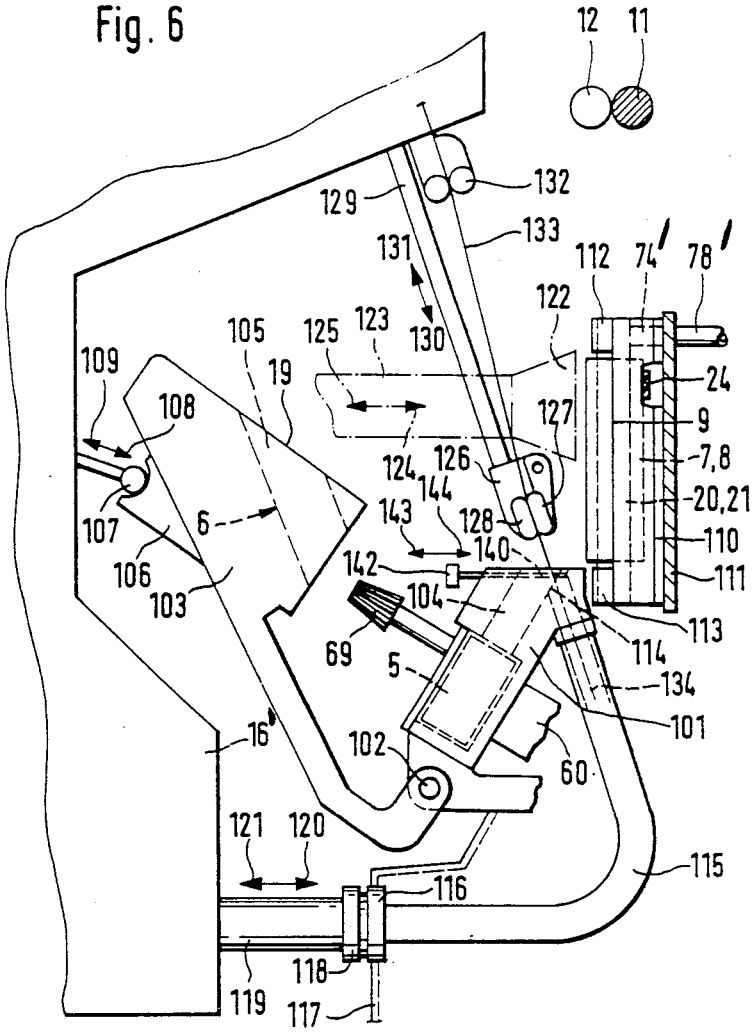
FIG. 6 is a partial sectional lateral schematic view of another embodiment of a spinning unit during the start of the operation of a servicing apparatus.

In the case of the embodiment according to FIG. 6, the opening roller 5 is disposed in an opening roller housing 101 and is driven preferably by a tangential belt running through in the longitudinal direction of the machine in a manner that is not shown in further detail. The opening roller housing 101 is equipped with a pivotal shaft 102 on which a partial housing 103 is disposed which takes up the area in front of the wedge-shaped gap and with a segment 105, continues the fiber feeding channel 6 started with a segment 104 in the opening roller housing 101. As shown in FIG. 6, the partial housing 103 is pivoted away in such a manner that the wedge-shaped gap 9 is exposed. The pivoting away is effected by an actuating element 107 of the servicing apparatus 16' that can be placed at a carrier piece 106 of the partial housing 103 and can be moved in directions corresponding to Arrows 108 and 109. It is therefore possible to completely expose the rollers 7 and 8 in the area of the wedge-shaped gap 9. The rollers 7 and 8 are located in a roller housing 110 which is fastened at a support 111 of tne machine frame. In the roller housing 110, the tube-shaped suction inserts 20 and 21 are wedged in by means of thrust pieces 112, said suction inserts 20 and 21 being connected by means of a duct 74' with a vacuum pipe 78'. The tangential belt 24 runs against the shell surfaces of the rollers 7 and 8 in a recess of the roller housing 110.

The mouth 114 of an auxiliary suction duct connected via a suction pipe 115 to the connection 116 leads into the segment 104 of the fiber feeding channel of the opening roller housing 101. The connection is located in the cover on the front side of the spinning unit 1. A connection piece 118 of the servicing apparatus 16' is applied to this connection 116 and is movable in directions corresponding to the arrows 120 and 121, said connecting piece 118 being connected with a vacuum pipe 119. In the connection piece 118, a flap valve is preferably arranged which is opened when the connection piece 118 is applied and which closes automatically when the connection piece 118 is withdrawn.

The servicing apparatus 16' is equipped with a suction nozzle 122 that is outlined by a dash-dotted line, said suction nozzle 122 being connected with a suction pipe 123 and being selectively movable to the opened spinning unit 1 in the area of the wedge-shaped gap 9 in the direction of the Arrows 125, 125. Preferably, nozzle 122 is also driven to perform a movement in the longitudinal direction of the wedge-shaped gap so that the whole area of the wedge-shaped gap 9 can be subjected to intensive cleaning. As desired, the suction nozzle 122 may also be coupled with a mechanical cleaning means, such as a brush according to preferred contemplated embodiments of the invention. In addition, embodiments are contemplated where it is provided that the suction nozzle is pivoted into the area of the segment 104 of the fiber feeding channel 6.

In the case of the embodiment according to FIG. 6, the servicing apparatus 16' is provided with a yarn clamp 126 with two clamping jaws 127 and 128 clamping the yarn end section 113 which previously was led through a stationary pair of auxiliary withdrawal rollers 132. The yarn clamp 126 is arranged on a rod 129 that can be selectively movably applied to the mouth 114 of the auxiliary suction means in the direction of the Arrows 130 and 131. The yarn end section 133 is applied to the opened spinning unit 1 in such a way that with its free end 134, it is opposite the mouth 114 of the auxiliary suction means and is sucked into it. After the opening of the clamping jaws 127 and 128, the yarn end can be transported in both directions by the actuating of the auxiliary withdrawal rollers 132.

Also in the case of the embodiment according to FIG. 6, a short switching-on of the sliver feeding device takes place before the actual piecing process, by means of which a fiber beard of a certain shape is produced so that in each case a defined quantity of yarn is present for the piecing process starting subsequently after an exact time interval. The fibers opened up during the preparation of the sliver can be transported away in different manners. It is contemplated, for example, to carry out the preparatory feeding of the sliver already before the opening of the spinning unit 1 so that the fibers will then reach the wedge-shaped gap 9 and are taken away after the opening of the spinning unit by means of the normal cleaning operation. It is also contemplated to carry out the preparatory feeding of the sliver when the spinning unit 1 is open, in which case it is then advantageous to apply the suction nozzle 122 to the segment 104 of the fiber feeding channel 6 of the opening roller housing 101 so that the fibers separated in this preparatory feeding are taken away directly by means of the suction nozzle 122 without reaching the wedge-shaped gap 9.

In the case of the embodiment according to FIG. 6, it is also provided that the opening roller housing 101 is equipped with a slider 140 by means of which the fiber feeding channel—in transport direction of the fibers—can be closed behind the mouth 114 of the auxiliary suction means. For actuating the slider 140, the servicing apparatus 16' is provided with a thrust piece 142 which can be moved out corresponding to the Arrows 143 and 144. In this case, while the preparatory feeding of the sliver takes place for the preparation of a predetermined fiber beard configuration, the auxiliary suction means can be "short-circuited" via the mouth 114 and connected directly with the first segment 104 of the fiber feeding channel 6. The opened up and divided out fibers are then sucked off directly without reaching the wedge-shaped gap 9. This step can be carried out when the spinning unit 1 is opened or when it is closed.

It should be understood that preferred embodiments according to FIGS. 5 and 6 are intended as diagrammatic variants and that other preferred embodiments are contemplated with features of these embodiments of FIGS. 5 and 6 combined with one another. Thus it is also contemplated without difficulties to provide, instead of the suction pipe 76 according to FIG. 5, a connecting duct 115 corresponding to FIG. 6 that can be connected to the servicing apparatus 16. It is also contemplated to provide means in the case of the embodiment according to FIG. 6 by means of which the suction device (suction inserts 20 and 21) can be switched on and off at indicated points in time. It is also contemplated in the case of the embodiment according to FIG. 6 that the yarn end 133 is again entered into the spinning unit only when the spinning unit 1 is closed again after a cleaning.

Following are explanations of the time sequences of the individual process steps graphically depicted in FIGS. 7 to 20. It is stressed that these explanations have not taken into account whether the process steps were commanded by the spinning unit 1 or by the servicing apparatus 16, 16' since the explanation applies to any of those situations. On the abscissa of the diagrams, time periods are entered, where the graphically depicted length of the time periods is not true to scale for illustration purposes. On the ordinates (vertical axis) only data are indicated as to whether the concerned functional element is switched on (reference sign I) or switched off (reference sign O). The transition time from one operational condition to stoppage or vice versa are given only in diagram form and it is not explained how long these accelerating times are in each case. These functional elements may vary in their design according to various preferred embodiments. The letters were applied as follows:

A—for the feeding device, especially for the feeding roller, i.e. it is shown whether the drive of the feeding roller is switched on (reference sign I) or switched off (reference sign O);

B—the rollers 7 and 8, i.e. whether the rollers are connected to a drive (reference sign I) or separated from it (reference sign O). In this case, it is not taken into account that possibly a driving of the rollers is carried out during a cleaning process by switching on the drive via the tangential belt 24 or via the auxiliary drive 48 of the servicing apparatus;

C—the operational suction device—suction inserts 20 and 21, where it is shown whether these are connected to the vacuum source (reference sign I) or not (reference sign O);

D—the auxiliary suction device 76 or 119, where in this case also only the switched-on condition (reference sign I) or the switched-off condition (reference sign O) are shown;

E—the covering of the wedge-shaped gap 9 by the partial housing 103, i.e., in the covered condition (reference sign I) or in the exposed condition (reference sign O);

F—an external cleaning of the servicing apparatus 16, especially the application and operation of the suction nozzle 122 (FIG. 6), where, also in this case, only the switched on condition (reference sign I) and the switched off condition (reference sign O) are shown;

G—designates the functional elements for the yarn transport, i.e., the yarn transport of the yarn end 133 to be returned as well as the yarn withdrawal taking place in connection with the piecing. Without supplying information on the respective speed, it is indicated when no yarn transport takes place (reference sign O), the yarn is withdrawn in withdrawal direction (reference sign I) or the yarn is returend into the area of the wedge-shaped gap 9 (reference sign II).

For a further explanation of the diagrams, it should also be mentioned that it is basically assumed that at the point in time a, the sliver feeding device A and the drive B of the rollers 7, 8 is switched off. In this case, it can be provided that corresonding to FIG. 3 together with a yarn breakage, an interruption of the drive of the rollers 7 and 8 takes place at the same time. However, it may also be provided that the interruption of the drive of the rollers 7 and 8 is carried out by the servicing apparatus 16 after it stops at the spinning unit 1 in need of servicing.

Figure 7:
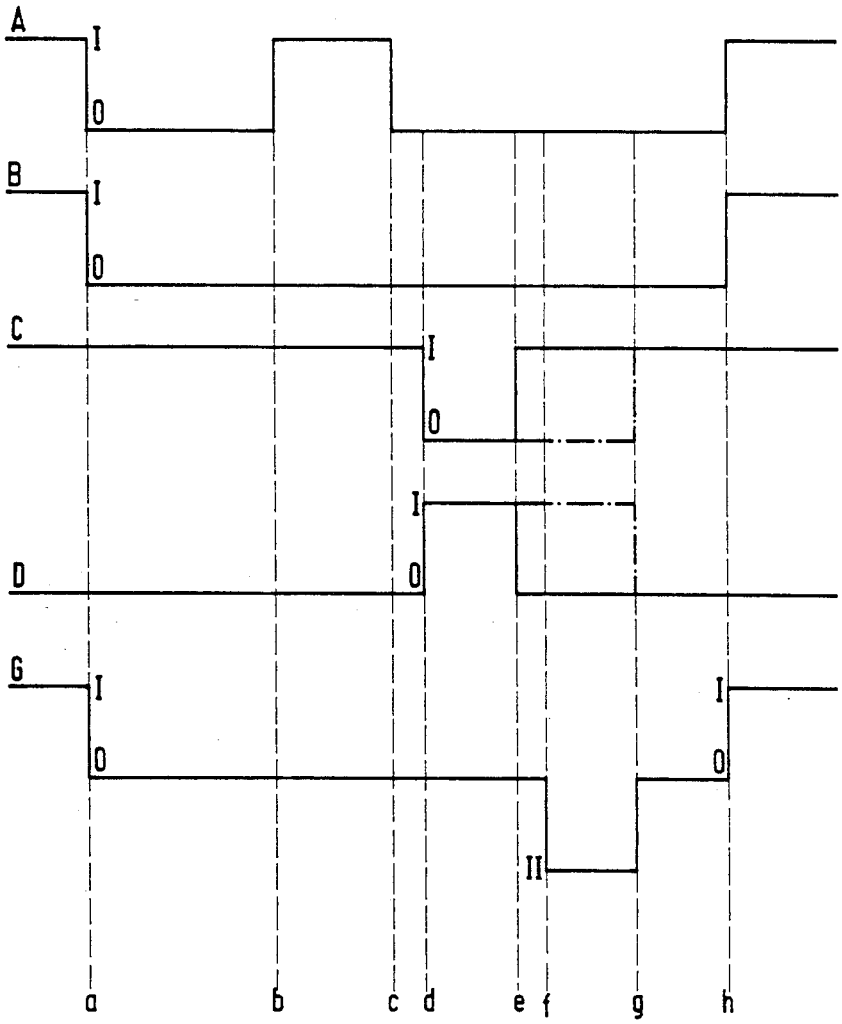
FIGS. 7 to 20 are diagrams graphically depicting the time sequence of the individual process steps before the actual piecing process and during the preparation of the end of tne sliver in accordance with preferred embodiments of the present invention.

The diagram of FIG. 7 describes the time sequence of the process steps according to claim 13. It is assumed that a yarn breakage takes place at the point in time a. It is recognized that, triggered by the yarn guard, the rollers 7 and 8 as well as the feeding roller 4 are switched off, because the curves A and B, from their operational condition according to reference sign I go over into the inoperational condition according to reference sign O. Starting from the point in time a, naturally there is, because of the broken yarn, no more yarn withdrawal even if the withdrawal rollers 11 and 12 should continue to turn. Accordingly, the curve G goes from the operational condition according to I into the inoperational condition according to O. Therefore, after a yarn breakage, the rollers 7 and 8 and the feeding roller 4 are stopped, but a so-called fiber caterpillar/cocoon exists in the wedge-shaped gap 9. The suction device 20, 21 is switched on.

The time interval between the time a and the time b in principle may be arbitrary. During the period between a and b a very differentiated combing-out of the fiber beard 59 takes place by means of the opening roller 5. Starting at the point in time b, the preparation of the fiber beard 59 for a piecing process is started in such a way that for each piecing process, always the same combing-out condition is obtained. At the point in time b, the servicing apparatus 16, with a closed spinning unit 1, for a short time drives the feeding roller 4 directly or indirectily, namely until a point in time c at which the feeding roller 4 is switched off again. Starting at that point c until the immediate start of the piecing, the same time interval must now always exist so that at the start of the actual piecing process, the same type of fiber beard 59 exists in each case, i.e., the piecing is always formed by the same quantity of fibers.

At the point in time d, the suction device 20, 21 is switched off and at the same time, the auxiliary suction device 76 or alternatively 119 is switched on. As a result, the fiber caterpillar as well as the waste fibers fed to the wedge-shaped gap 9 by the short switching-on and switching-off of the feeding roller 4 are sucked off by the auxiliary suction device 76 or 119. At this point in time, the operational suction device 20, 21 is switched on again and the auxiliary suction device 76 or 119 is switched off again. At the point in time f, the yarn end 133 is applied to the wedge-shaped gap 9, in this case, is held in the area of the mouth 114 or 75 of the auxiliary suction device 76 or 119. At the point in time g, the return of the yarn end 133 is concluded.

Now, the actual piecing process can start, which is marked by the switching-on of the yarn withdrawal device G, the driving of the rollers 7 and 8 and the switching-on of the feeding roller 4. This takes place at the point in time h. As necessary, the respective start of the rollers 7 and 8, of the feeding roller 4 and of the yarn withdrawal device can be shifted sightly with respect to one another.

It is important that the same time interval always occurs between the points in time b and h, because as a result, the quantity of the individual fibers fed to the piecing point is determined.

The procedural sequence according to FIG. 7 is particularly simple. The spinning unit 1 does not have to be opened for the piecing, separate cleaning devices of the servicing apparatus 16 are not required because the auxiliary suction device also takes over this function. Apart from the feeding roller 4, each functional element is actuated only once. As indicated by dash-dotted lines, the sequence may also be modified in such a way that the auxiliary suction device D remains switched on until the end of the return of the yarn end (point in time g) and the suction device C remains switched off.

Figure 8:
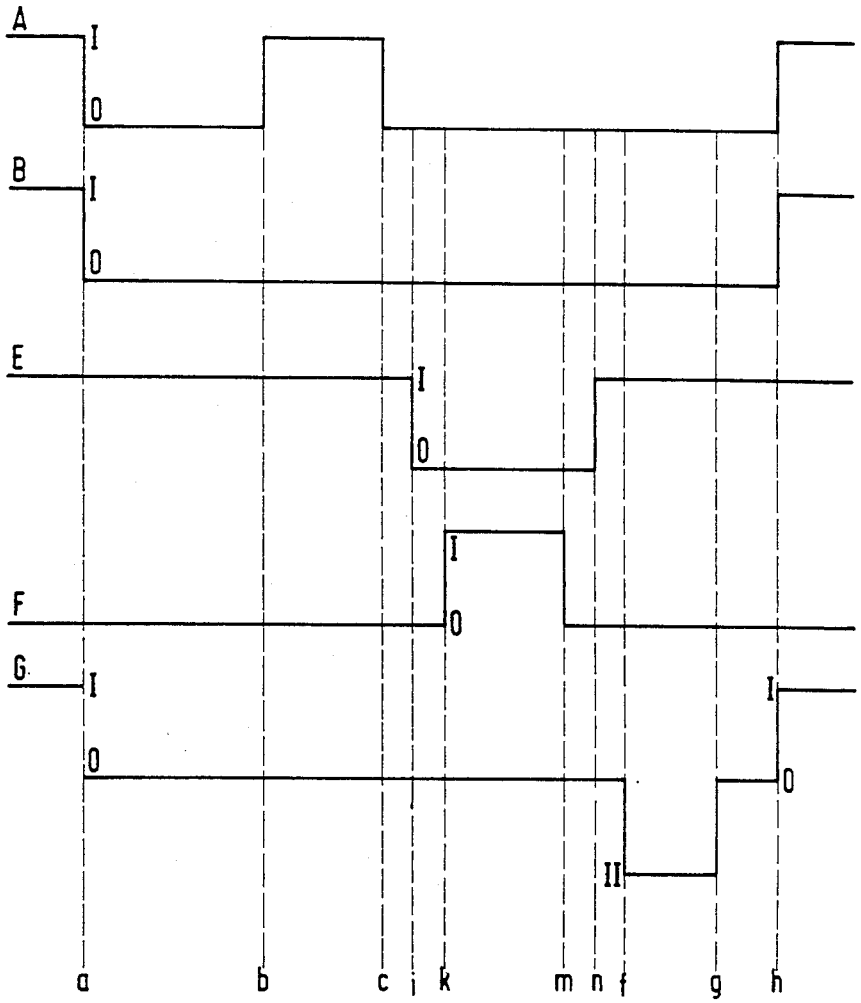

The process steps shown in FIG. 8 explain claim 14. To the point in time c, the sequence corresponds to that of the process steps according to FIG. 7. The essential difference as compared to the sequence of FIG. 7 is the fact that in the case of FIG. 8, at a point in time i, thus immediately after the switching-on and switching-off of the feeding roller 4, the wedge-shaped gap 9 is exposed by a pivoting away of the partial housing 103. This takes place by means of the opening lever 107 of the servicing apparatus 16'. The suction nozzle 122, as necessary in connection with the mechanical means that are not shown, removes the fiber caterpillar as well as the waste fibers resulting from the short switching-on and switching-off of the feeding device. This takes place between time segments k and m. At the point in time n, the wedge-shaped gap 9 is covered again by the closing of the spinning unit 1. The subsequent process steps, thus from time segments f to h, are again the same as those described in FIG. 7.

By means of the process steps according to FIG. 8, the advantage may possibly be achieved that the surface of the rollers 7 and 8 and especially the wedge-shaped gap 9 are to be cleaned more thoroughly. In addition, there is the advantage that the operational suction device 20, 21 does not have to be switched off. Also, the auxiliary suction device 76 or 119 is not required.

Figure 9:
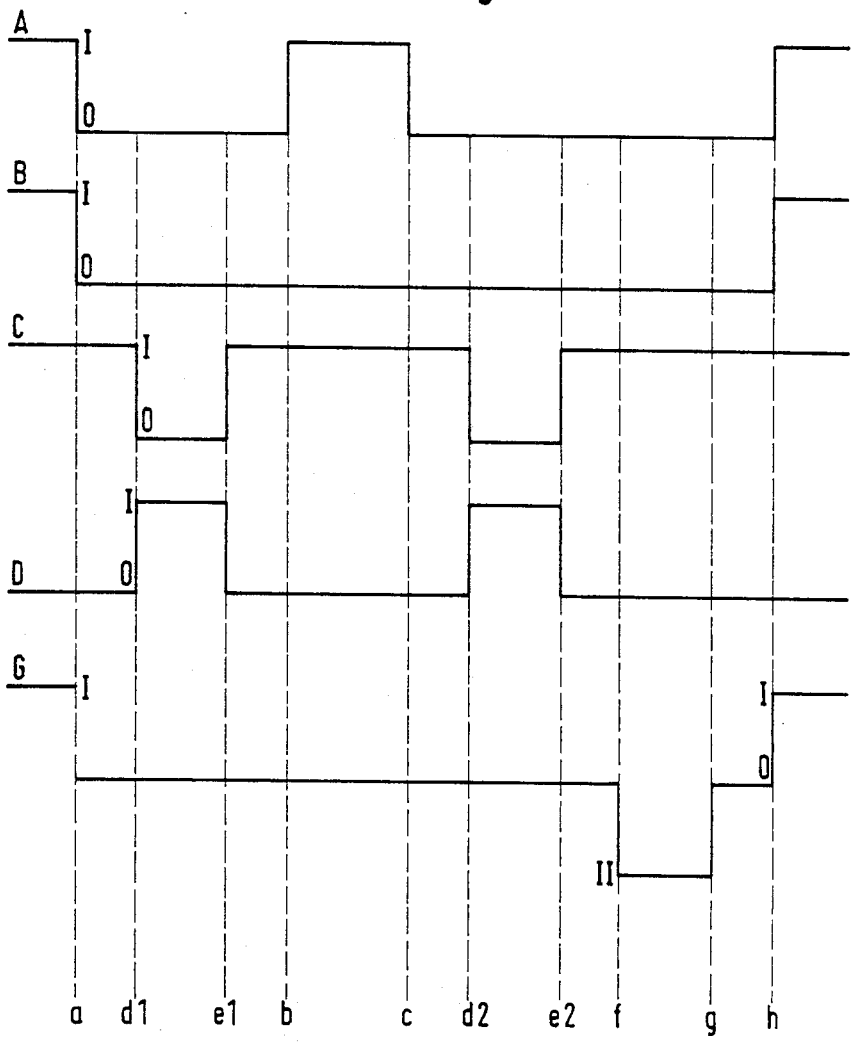

The sequence of process steps according to FIG. 9 explains claim 15. Upon a yarn breakage, the rollers 7 and 8 as well as the feeding roller 4 are stopped, see point in time a. At the same time, no more yarn is withdrawn from the wedge-shaped gap 9. A fiber caterpillar still adheres in the wedge-shaped gap. The suction device 20, 21 is not yet switched on.

At the point in time $d_1$, the servicing apparatus 16, 16' closes the suction device 20, 21 and at the same time opens the auxiliary suction device 76 or 119, the mouth 75 or 114 of which is located at one end of the wedge-shaped gap 9. As a result, the fiber caterpillar first arrives in the auxiliary suction device. At the point in time $e_1$, this process is concluded, i.e., the suction device 20, 21 is switched on again and the auxiliary suction device 76 or 119 is switched off again.

Between the points in time b and c, the feeding roller 4 will then be briefly turned on and turned off. The result is the prepared fiber beard 59.

At the point in time $d_2$, the suction device 20, 21 is switched off again and the auxiliary suction device 76 or 119 is switched on again. As a result, the waste fibers resulting from the preceding brief switching-on and switching-off of the feeding roller 4 arrive also in the auxiliary suction device 76 or 119. This process is concluded at the point in time $e_2$, at which time the suction device 20, 21 is switched on again and the auxiliary suction device 76 or 119 is switched off again.

The subsequent process steps at points in time f, g and h are again the same as those described according to FIGS. 7 and 8.

The essential difference of the process steps according to FIG. 9 as compared to the process steps according to FIG. 7 is the fact that the fiber caterpillar caused by the yarn breakage and the waste fibers caused by the preparation of the fiber beard 59 are each led off separately. This slightly prolongs the clock time for the piecing process, but on the other hand has the advantage that the leading-off of the fiber residues and waste fibers takes place more thoroughly. This is especially important if the fiber caterpillar resulting from the yarn breakage should be too thick.

Figure 10:
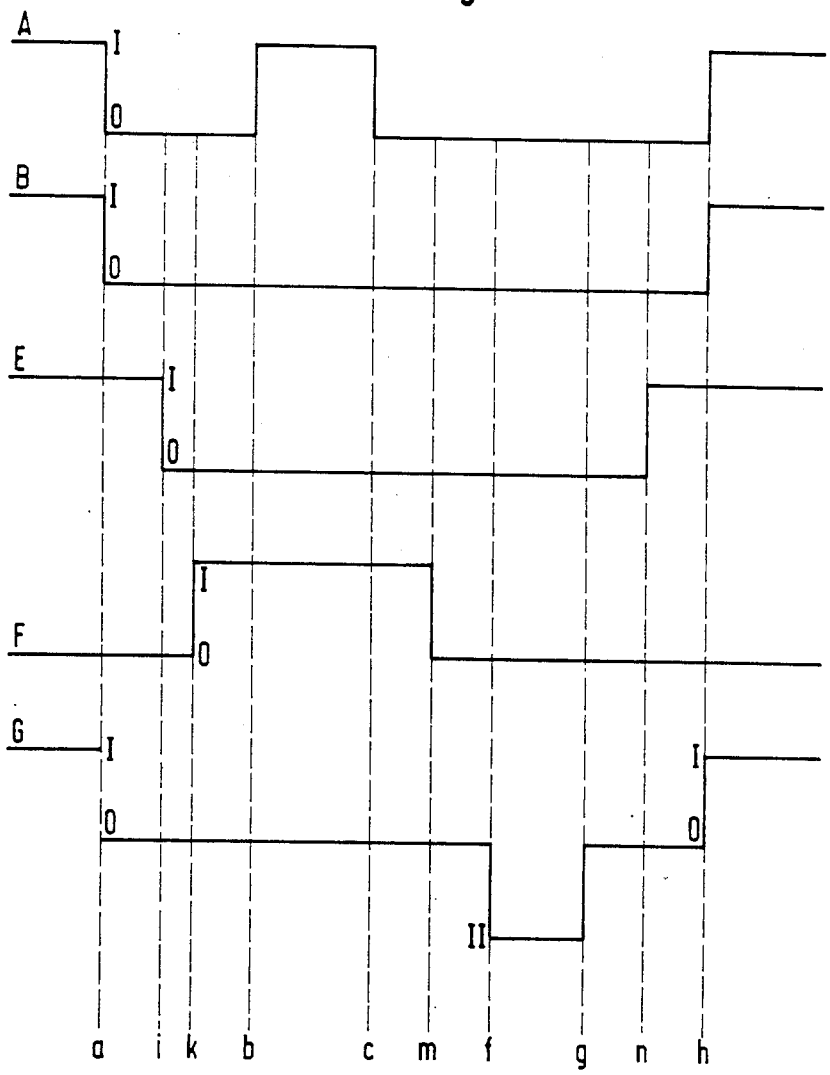

The process steps described in FIG. 10 concern claim 16. They correspond approximately to the process steps described with respect to FIG. 8, with the difference that the wedge-shaped gap 9 is already exposed immediately after the yarn breakage and is covered again only immediately before the switching-on of the yarn withdrawal device (points in time i and n). The brief switching-on and switching-off of the feeding roller 4 (time period b to c) therefore takes place with an exposed wedge-shaped gap 9 so that the waste fibers do not even arrive in the wedge-shaped gap 9 but are taken up directly by the suction nozzle 122 of the servicing apparatus 16'. As a result, the cleaning by means of the servicing apparatus 16' takes place already before the switching-on of the feeding roller 4 and lasts until after the switching-off again of the feeding roller 4; see points in time k to m for the start of the cleaning device of the servicing apparatus 16. As a result, the fiber caterpillar is led off already before the switching-on of the feeding roller 4, and after the switching-off again of the feeding roller 4, the residual fibers combed out of the fiber beard 59 are also led off. Subsequently, as shown at points in time f to g, the yarn end 133 is returned with a covered wedge-shaped gap 9. The spinning unit 1 will be closed again only then.

The process steps explained in FIG. 10 have the advantage that a switching-off of the suction device 20, 21 again is not required, and an auxiliary suction device 76 or 119 is also not required. In addition, the whole process takes place while the spinning unit 1 is open, making it possible for an operating person to check the operativeness, if necessary.

Figure 11:
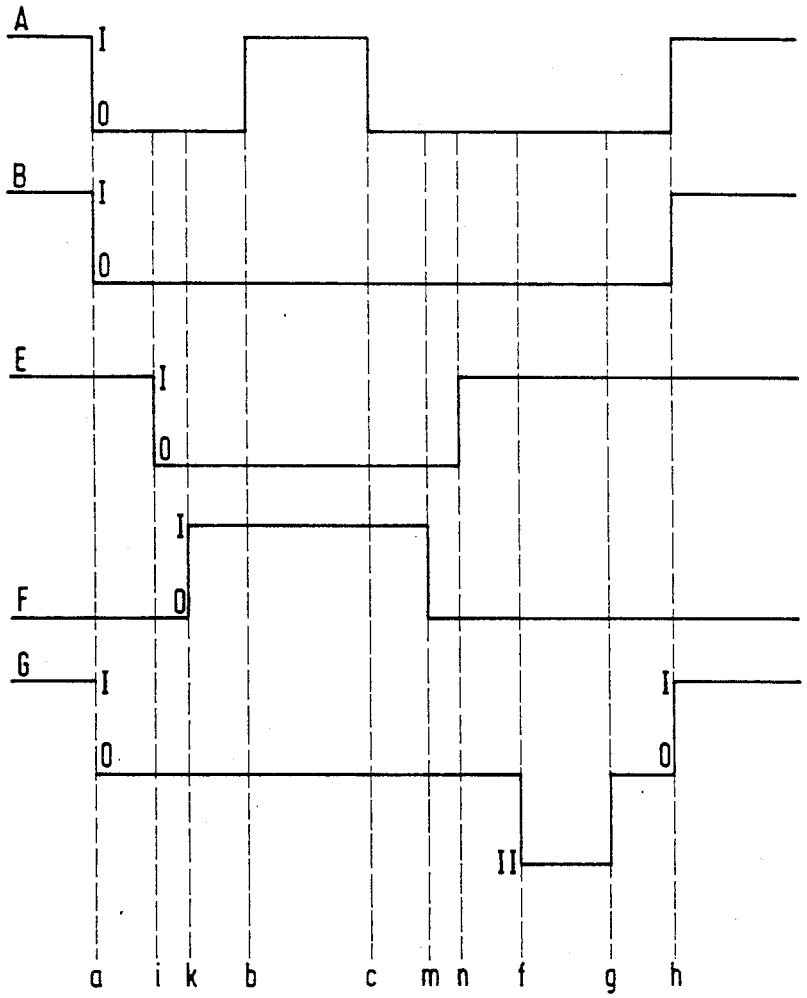

The process steps shown in FIG. 11 correspond to claim 17. The process steps according to FIG. 11 differ from tne process steps according to FIG. 10 only because of the fact that before the placing of the yarn end 133 in the wedge-shaped gap 9, the spinning unit 1 is closed again; see point in time n of the covering of the wedge-shaped gap before point in time f of the return of the yarn end 133. In all other process steps, FIGS. 10 and 11 are the same.

Figure 12:
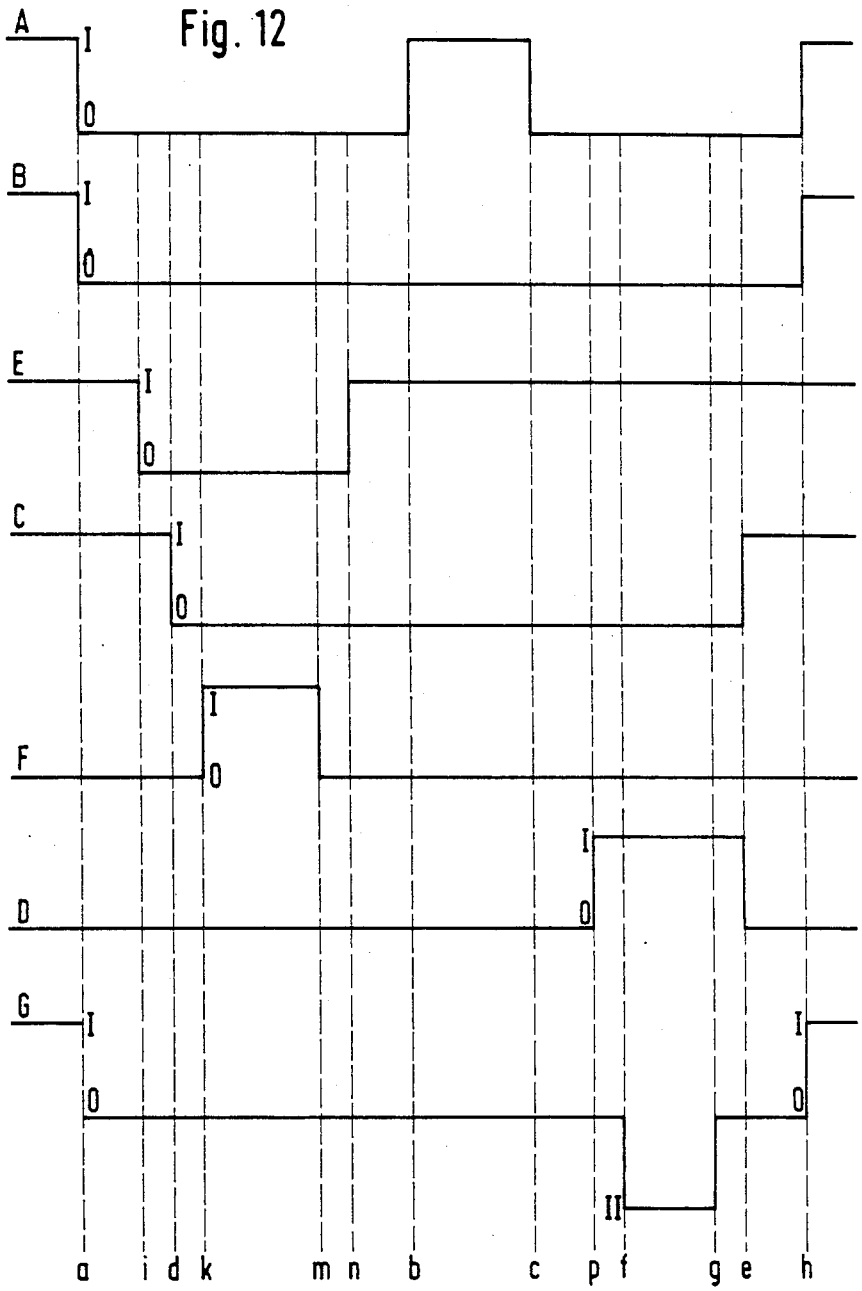

The sequence of tne process steps according to FIG. 12 concerns claim 18. As a deviation from all other previously described process steps, it is provided here that a cleaning device of the servicing apparatus 16 as well as an auxiliary suction device 76 or 119 are required. It is true that the process steps therefore are relatively high in expenditures, but on the other hand, especially reliable.

Immediately after a yarn breakage (point in time a), at which the feeding roller 4 and the rollers 7 and 8 are stopped and starting at which no more yarn withdrawal takes place, the wedge-shaped gap 9 is exposed at a point in time i. Simultaneously or shortly afterwards, the servicing apparatus 16 switches off the suction device 20, 21 so that the fiber caterpillar can be detached more easily from the surface of the rollers 7 and 8. Immediately afterwards, at a point in time k, a cleaning device of the servicing apparatus 16, such as tne nozzle 122 for the removal of the fiber caterpillar resulting from the yarn breakage, is applied up to a point in time m. Immediately afterwards, at a point in time n, the wedge-shaped gap 9 is covered again. Now, while the spinning unit is closed, between points in time b and c, a brief switching-on and switching-off of the feeding roller 4 takes place for the preparation of the fiber beard 59. So that—while the suction device 20, 21 is still switched off—the residual fibers resulting from the preparation of the fiber beard 59 can be led off, the auxiliary suction device 76 or 119 is switched on at the point in time p. Shortly afterwards, at the point in time f, the yarn end 133 is also applied to the wedge-shaped gap 9, in which case it is advantageous for the holding-fast of the free end 134 of the yarn end 133 that the auxiliary suction device 76 or 119 is still switched on. At the point in time g, the return of the yarn end 133 is concluded, and because the residual fibers are also sucked off, the auxiliary suction device 76 or 119 may be switcned off again at a point in time e. At the same point in time, the operational suction device 20, 21 is also switched on again. Then, at point in time h, the actual piecing process takes place, namely by switching-on the pair 97 or 132 of auxiliary withdrawal rollers, the rollers 7 and 8 as well as the feeding roller 4. The sequence of the switching-on of the latter functional elements may vary in this case.

Figure 13:
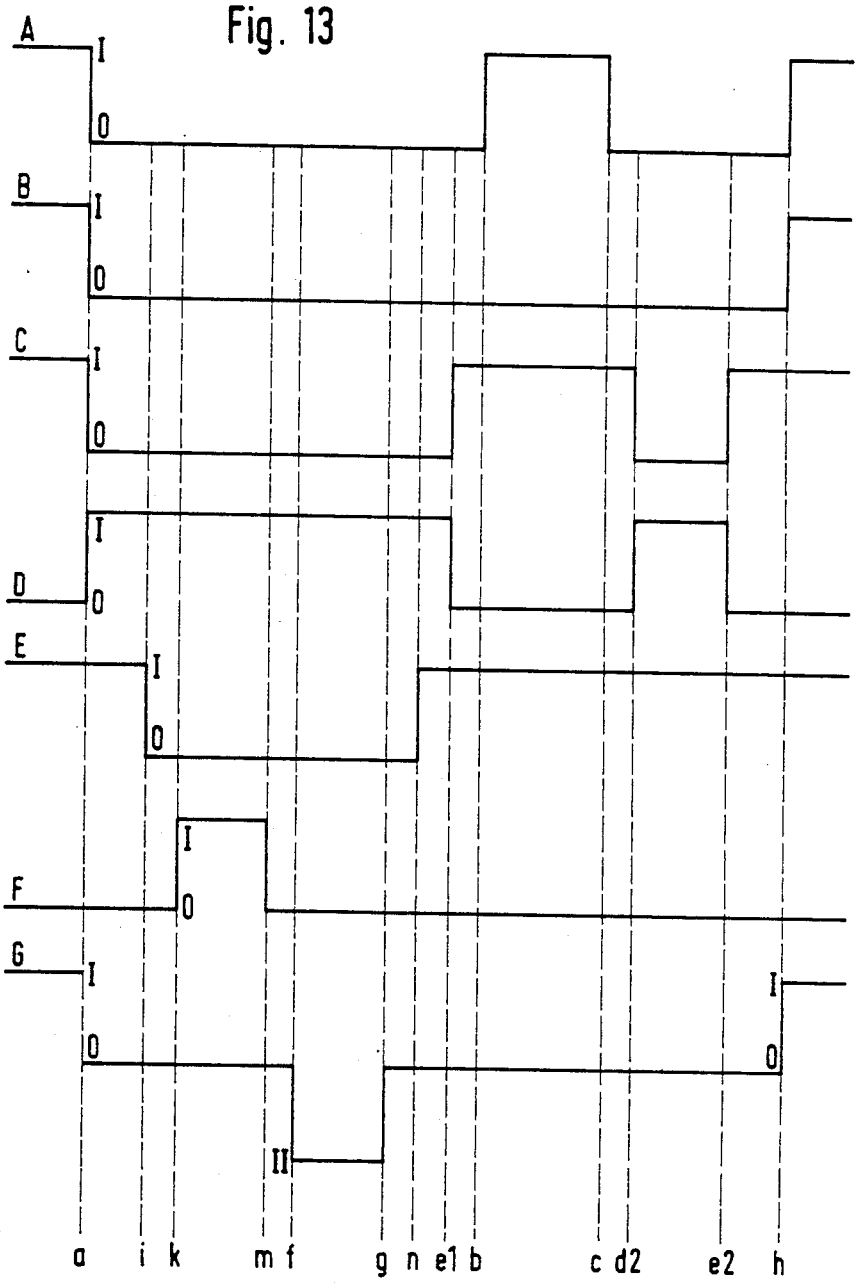

The sequence of the process steps according to FIG. 13 refers to claim 19. They can be best compared with the process steps according to FIG. 12 because here also, a cleaning device of the servicing apparatus 16 as well as the connection of the spinning unit 1 to an auxiliary suction device 76 or 119 are provided. As a deviation from all other previously descrioed embodiments, it is, however, provided in FIG. 13 that in the case of a yarn breakage at the point in time a, not only the feeding roller 4 and the rollers 7 and 8 are stopped, but that at the same time, controlled by the yarn monitoring device, the suction device 20, 21 is switched off and the auxiliary suction device 76 is switched on. At a subsequent point in time i, the wedge-shaped gap 9 is exposed, wherein this condition, first the fiber caterpillar is removed (time segments k to m) and afterwards the yarn end 133, with an open spinning unit, is applied to the wedge-shaped gap; see time segments f and g. Only afterwards, at the point in time n, the wedge-shaped gap 9 is covered again.

At the point in time $e_1$, the suction device 20, 21 is switched on again by the servicing apparatus 16 and the auxiliary suction device 76 is switched off. As a result, the waste fibers which occur because of the subsequent brief switching-on and switching-off of the feeding roller between points in time b and c, can reach the wedge-shaped gap 9. After the switching-off of the feeding roller 4, the suction device 20, 21 is switched off again at the point in time $d_2$ and the auxiliary suction device 76 is switched on again, by means of which the waste fibers are led off. For restoring the operational condition, at the point in time $e_2$, the suction device 20, 21 is switched on again and the auxiliary suction device 76 is switched off again. At the point in time h, the actual piecing process will then take place in the described way.

Figure 14:
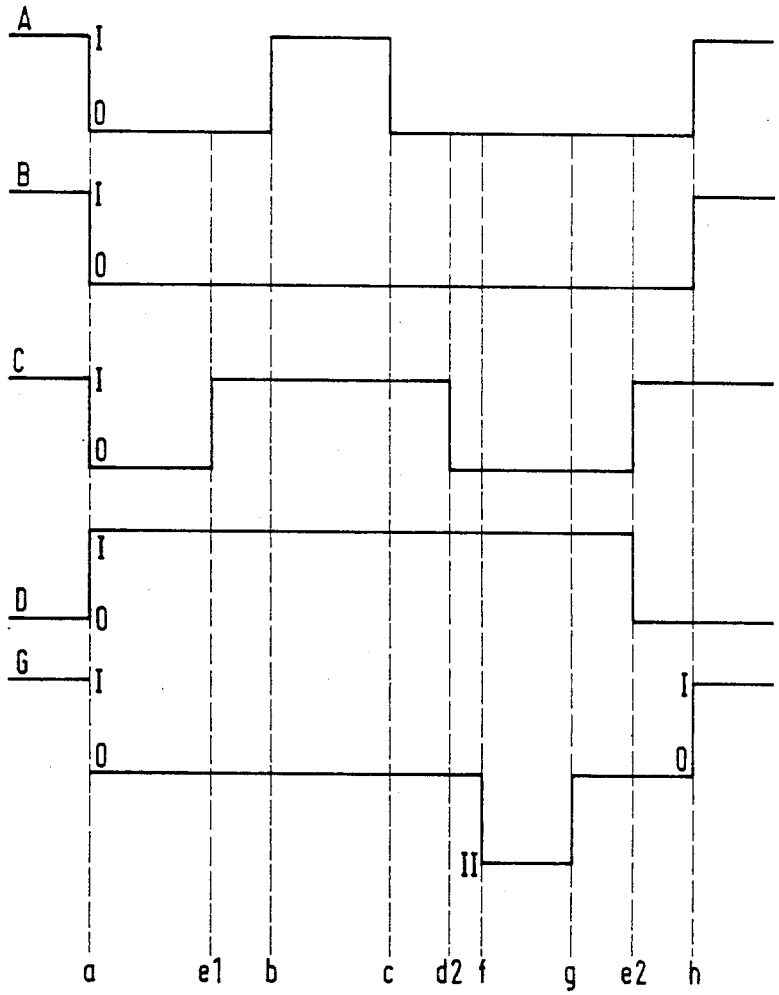

The process steps described in FIG. 14 which concern claim 20 can be compared with the process steps described in FIG. 13 to the extent that here also, in the case of a yarn breakage, already at point in time a, in addition to the feeding roller 4 and the rollers 7 and 8, the operational suction device 20, 21 is also switched off and the auxiliary suction device 76 is applied. An exposing of the wedge-shaped gap 9 as well as the cleaning by the servicing apparatus 16 is not provided so that in the case of the approach of FIG. 14, the clock time is particularly short. The yarn caterpillar resulting from the yarn breakage in this case arrives in the auxiliary suction device 76 automatically. So that the waste fibers occurring because of the switching-on and switching-off of the feeding roller 4 between points in time b and c arrive in the wedge-shaped gap 9, the suction device, at the point in time $e_1$, still before the switching-on of the feeding roller 4 is applied and is switched off again shortly after the switching-off of the feeding roller 4 at the point in time $d_2$. Since the auxiliary suction device 76 is still in operation, the waste fibers, via the mouth 75, arrive directly in the auxiliary suction device 76. While the auxiliary suction device 76 is still switched on, the return of the yarn end 133 takes place to the wedge-shaped gap 9 between points in time f and g. Only afterwards, at a point in time $e_2$, the auxiliary suction device 76 is switched off again and simultaneously, the operational suction device 20, 21 is applied again. Starting at point in time h, the actual piecing process will then take place in the described way.

Figure 15:
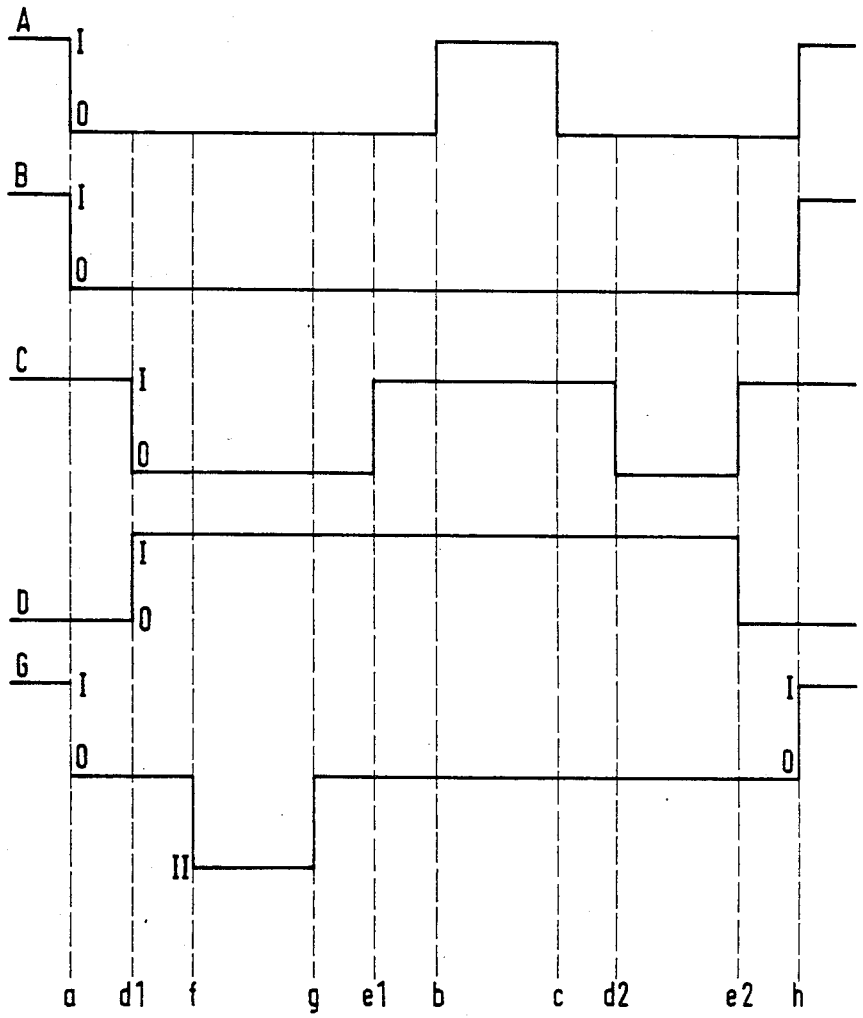

The process steps described in FIG. 15 refer to claim 21. In the case of a yarn breakage at the point in time a, the rollers 7 and 8 as well as the feeding roller 4 are stopped directly via the yarn guard. The servicing apparatus 16 then, at the piont in time $d_1$, switches off tne suction device 20, 21 and switches on the auxiliary suction device 76 or 119. Now, between the time segments f and g, the yarn end 133, while the spinning unit 1 is closed, is returned to the wedge-shaped gap 9. Then, at the point in time $e_1$, the suction device 20, 21 is switched on for a certain time interval so that during the preparation of the fiber beard, the waste fibers are sucked into the wedge-shaped gap 9. The preparation of the fiber beard takes place between time segments b and c, after which, at the point in time $d_2$, the suction device 20, 21 is switched off again for a time so that, by means of the still open auxiliary suction device 76 or 119, the waste fibers may be sucked off. At the point in time $e_2$, for the preparation of the actual piecing process, the operational suction device 20, 21 is switched on again and the auxiliary suction device 76 or 119 is switched off. At the point in time h, the actual piecing process will take place.

Figure 16:
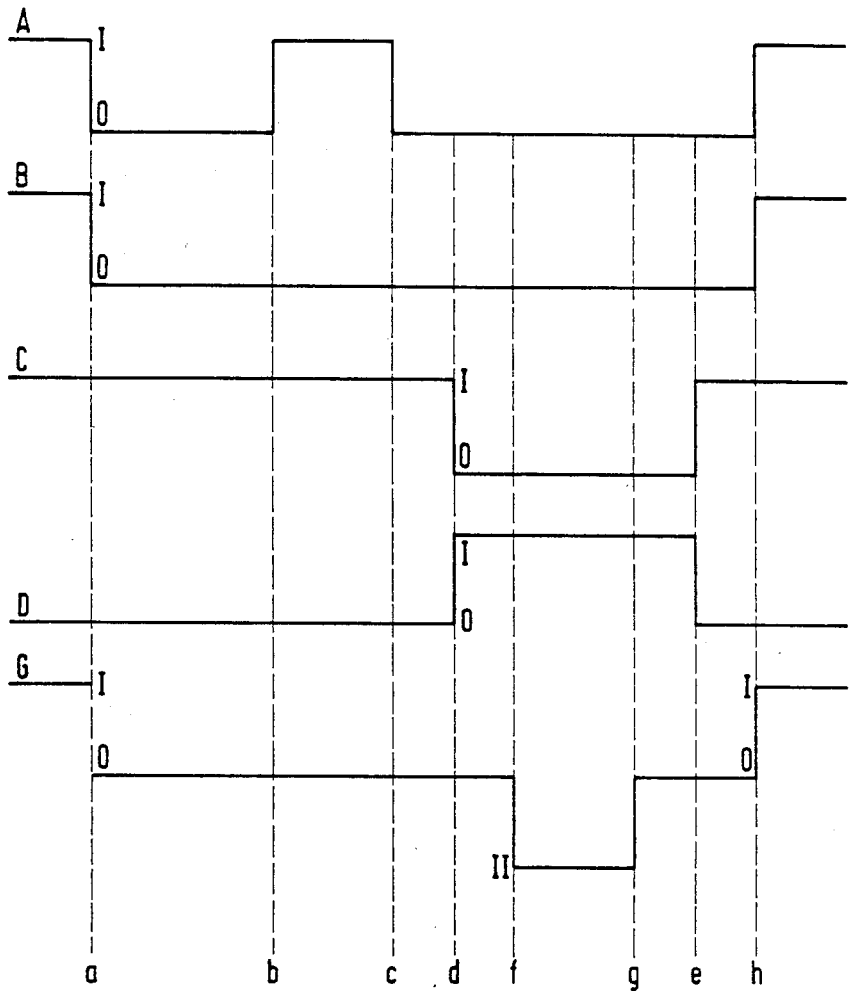

The process steps according to FIG. 16 refer to claim 22. They correspond essentially to the process steps already described in FIG. 7, with the only difference that the yarn end 133 to be returned into the wedge-shaped gap 9 is already returned at a point in time when the suction device 20, 21 is still switched off and the auxiliary suction device 76 or 119 is still switched on. The time period f and g is therefore within the time period d to e. Otherwise, the process steps of FIG. 7 and 16 are analogous.

Figure 17:
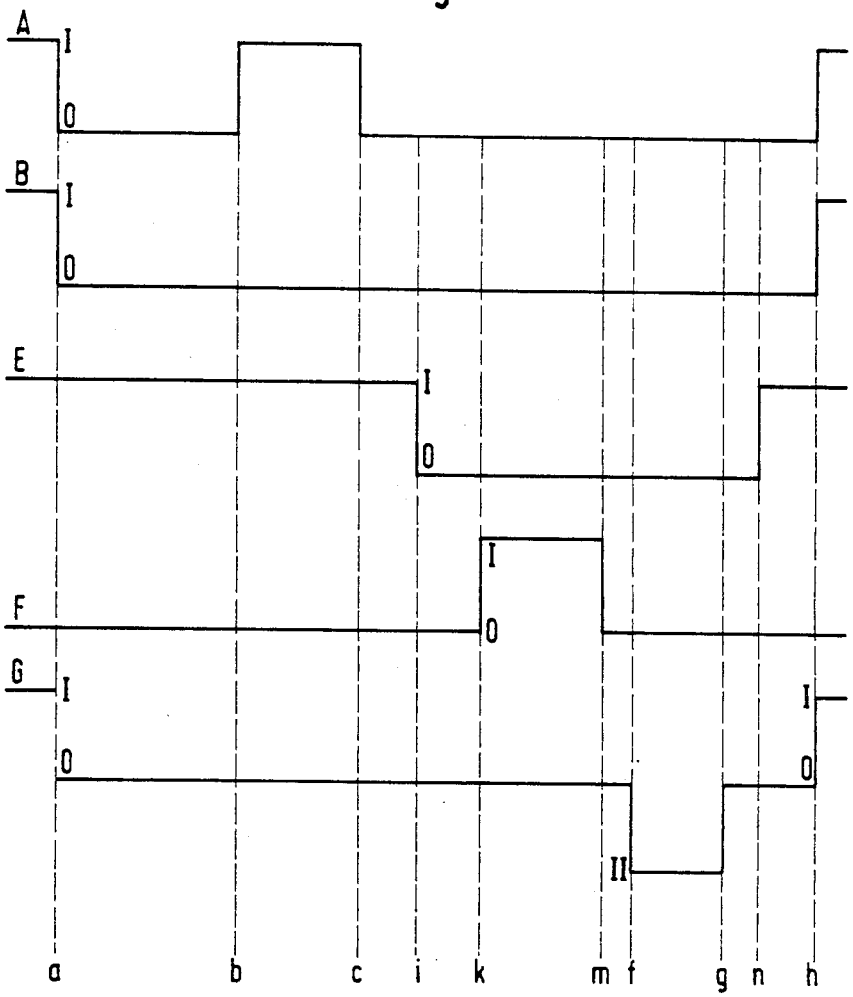

The sequence of the process steps shown in FIG. 17 explains claim 23. These process steps correspond to the process steps of FIG. 8 with the exception that the return of the yarn end 133 takes place while the spinning unit 1 is open. For this reason, the time period f to g provided for the return of the yarn end 133, in deviation from FIG. 8, is still within time segments i and n, in which the wedge-shaped gap 9 is exposed. Otherwise, the process steps according to FIG. 8 and 17 are analogous.

Figure 18:
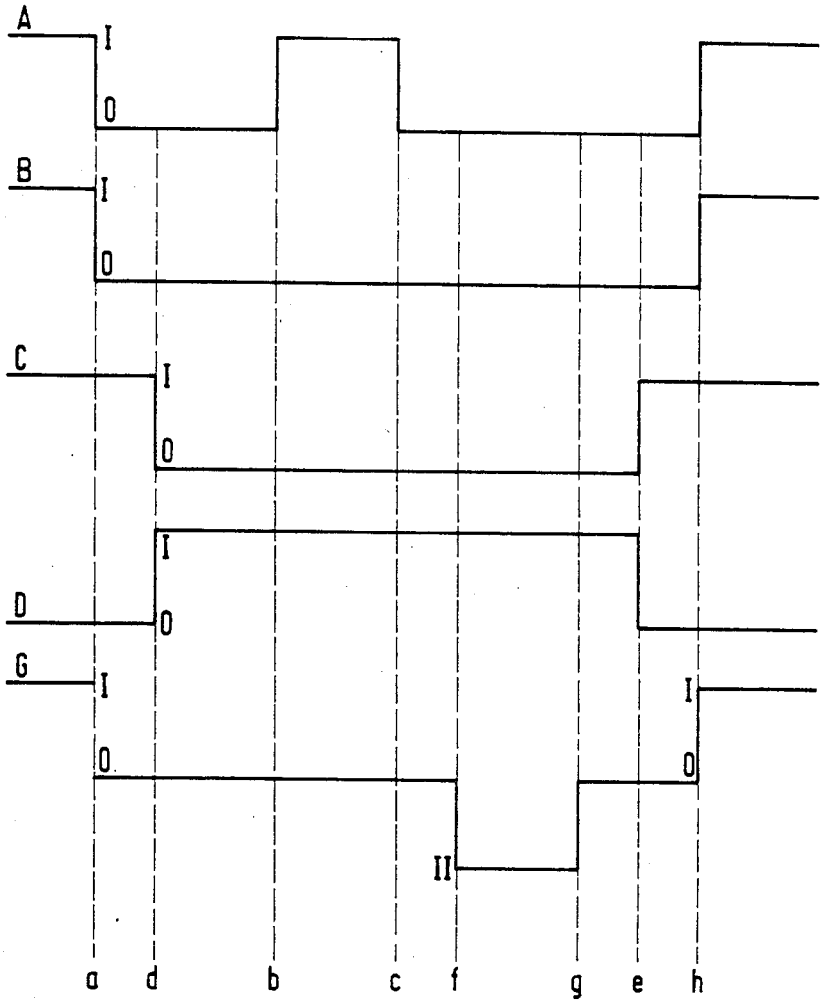

The process steps according to FIG. 18 refer to claim 24. They correspond essentially to the process steps described in FIG. 14, with two differences: on the one hand, the switching-off of the suction device 20, 21 and the switching-on of the auxiliary suction device 76 or 119 do not take place directly at the time of the yarn breakage, but at a slightly later point in time d; on the other hand, the suction device 20, 21 remains closed until immediately before the actual piecing process until point in time e (in the example of FIG. 14, the suction device 20, 21 inbetween was switched on again temporarily). Apart from that, the processes described in FIGS. 14 and 18 are analogous.

Figure 19:
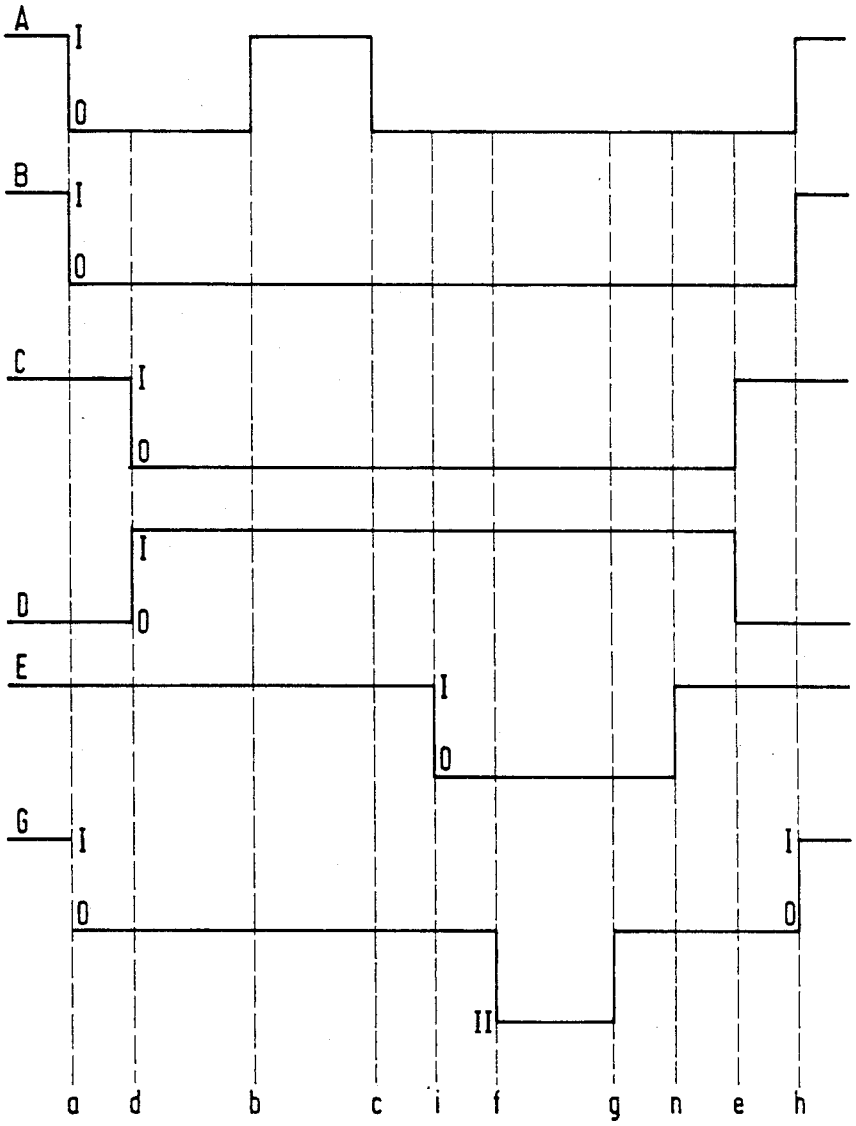

The process steps according to FIG. 19 concerning claim 25 deviate from the process steps described in FIG. 18 only because of the fact that for the return of the yarn end 133, the wedge-shaped gap 9 is exposed temporarily. As a result, the time period f to g provided for the return of the yarn end 133 is within the time period i to n provided for the exposing of the wedge-shaped gap 9. With the exception of the curve E, the process steps according to FIG. 18 and 19 correspond to one another.

Figure 20:
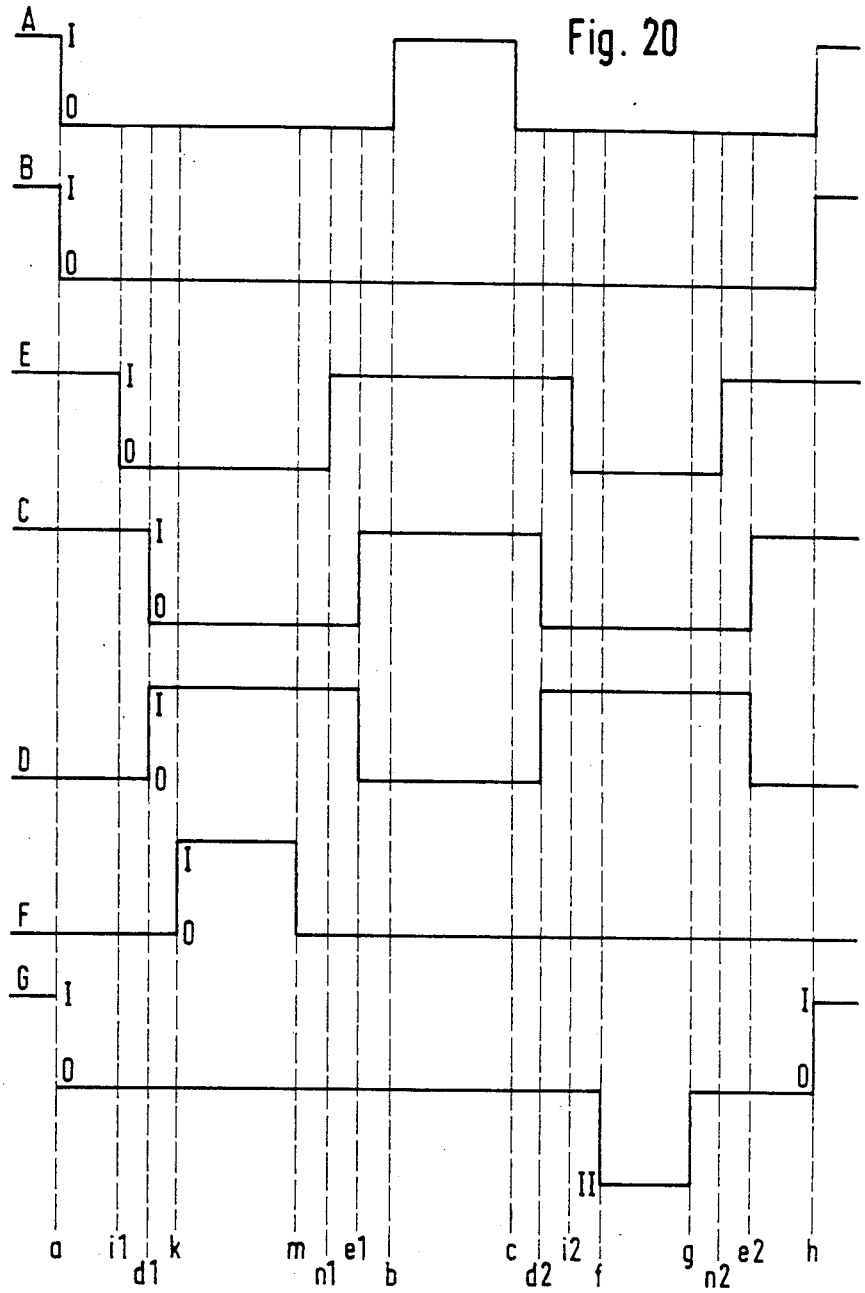

The process steps shown in FIG. 20 refer to claim 26. They seem somewhat costly with respect to the time sequence, but, on the other hand, are very clear and categorized very clearly with respect to the functional sequences. In the case of a yarn breakage, triggered by the yarn guard, the feeding roller 4 as well as the drive of the rollers 7 and 8 are switched off first. The suction device 20, 21 first remains still open. The servicing apparatus 16 then opens the spinning unit and switches off the suction device 20, 21 and switches on the auxiliary suction device 76, 119. In the process, the so-called fiber caterpillar is sucked off. Subsequently, a mechanical and pneumatic cleaning device of the servicing apparatus 16 is applied to the rollers 7 and 8. Then the spinning unit 1 is closed again. The exposure to suction of the rollers 7 and 8 is switched on and the auxiliary suction device 76, 119 is switched off. At the same time, the fiber beard 59 is prepared while the feeding roller 4 is briefly switched on and off. Now the suction device 20, 21 is closed again and the auxiliary suction device 76 and 119 is opened again, leading away the waste fibers. After the spinning unit 1 is opened again, the yarn end 133 is returned into the wedge-shaped gap 9, namely up to the mouth 75 or 114 of tne auxiliary suction device 76 or 119. After another closing of the spinning unit, the rollers 7 and 8 are started by means of tne auxiliary drive 48 as soon as the yarn is so far withdrawn by the pair of auxiliary withdrawal rollers 132 that the end 134 of the yarn end section 133 is located in the area of the mouth 19 of the fiber feeding channel 6. The suction device 20, 21 is now switched on again and the auxiliary suction device 76 or 119 is switched off again. At the same time, the feeding of fibers starts by the switching-on of the feeding roller 4. The yarn withdrawal is now accelerated by the pair 132 of auxiliary withdrawal rollers 132 to operational machine speed, as well as the feeding roller 4 and the rollers 7 and 8. Finally, the transfer of the pieced yarn takes place to the spinning unit 1 which concludes the piecing process.

Although the present invention has been descrioed and illustrated in detail, it is to be clearly understood that the same is by way of illustration and example only, and is not to be taken by way of limitation. The spirit and scope of the present invention are to be limited only by the terms of the appended claims.

What is claimed is:

1. A process for piecing yarn on an open-end friction spinning machine of the type having at least one spinning unit with:

a pair of friction rollers arranged adjacent one another to form a wedge-shaped yarn forming gap, friction roller driving means for driving the friction rollers in the same rotational direction during spinning operations, fiber opening means for separation fibers to be supplied to the yarn forming gap, said fiber opening means including a rotatably drivable opening roller means, sliver feeding means for feeding sliver to the fiber opening means, said sliver feeding means including a drivable sliver feeding roller means, primary suction means for applying suction forces to the yarn forming gap, and yarn winding means for winding the spun yarn on a spool, said process comprising:

returning a yarn end to the yarn forming gap to form a yarn piecing with, fibers supplied to the yarn-forming gap, feeding sliver to the opening means, removing from the spinning unit fibers opened up during feeding of the sliver preceding the actual piecing process, feeding fibers to the yarn-forming gap to form a yarn piecing with the yarn end, and withdrawing the yarn end with the yarn piecing connected therewith, whereby a predetermined constant supply of fibers are fed to the yarn forming gap for the piecing process by supplying a predetermined constant characteristic sliver end to the opening roller means for each piecing process.

2. A process according to claim 1, wherein before the actual piecing process, the sliver feeding means is switched on for an indicated time period and is switched off again at an exactly defined time interval before the start of the actual piecing process, the fibers separated into individual fibers before the actual piecing process by the opening roller means being led away from the spinning unit.

3. A process according to claim 1, wherein the fibers opened up during the feeding of the sliver preceding the actual piecing process are fed to the wedge-shaped gap and by means of a subsequent cleaning of the wedge-shaped gap are removed before the start of the actual piecing process.

4. A process according to claim 1, wherein each spinning unit is equipped with auxiliary suction means leading out into the area of the wedge-shaped gap and affecting exterior shell surfaces of the friction rollers, said auxiliary suction means being connected to a vacuum source at least during the feeding of the sliver preceding the actual piecing process.

5. A process according to claim 1, wherein the drive of the friction rollers is interrupted at least during the feeding of the sliver preceding the actual piecing process.

6. A process according to claim 1, wherein the suction effect of the primary suction means is reduced at least during the feeding of the sliver preceding the actual piecing process.

7. A process according to claim 4, wherein the primary suction means is connected to a pressurized air source while the auxiliary suction means is switched on at least for a short time.

8. A process according to claim 1, wherein the spinning units are provided with a removable covering for the wedge-shaped gap, wherein a cleaning device is provided that can be applied to the exposed wedge-shaped gap, and wherein the cleaning device is applied to the wedge-shaped gap after or during the feeding of the sliver preceding the actual piecing process.

9. A process according to claim 1, wherein the fibers opened up during the feeding of the sliver preceding the actual piecing process are removed from the spinning unit before reaching the wedge-shaped gap.

10. A process according to claim 9, wherein a fiber feeding channel connecting the opening roller means with the wedge-shaped gap is adapted to be exposed at least partially, and wherein during the feeding of the sliver preceding the actual piecing process, a device for receiving the individual fibers is applied to the at least partially exposed fiber feeding channel of this spinning unit.

11. A process according to claim 9, wherein each spinning unit is equipped with auxiliary suction means leading out into the area of the wedge-shaped gap and affecting exterior shell surfaces of the friction rollers, said auxiliary suction means being connected to a vacuum source at least during the feeding of the sliver preceding the actual piecing process wherein the auxiliary suction means of each spinning unit leads out into a fiber feeding channel connecting the opening roller means with the wedge-shaped gap, and wherein the fiber feeding channel is closed (by slide 140) behind the mouth of the auxiliary suction means during the feeding of the sliver preceding the actual piecing process.

12. A process according to claim 1, wherein before the actual piecing process, the feeding of the sliver is switched on for a certain time period and subsequently is switched off again, the end of the sliver existing after the switching-off being moved back from the area of the opening roller means and the fibers opened up by the opening roller means before the actual piecing process being led away from the spinning unit.

13. A process according to claim 4, wherein after the switching-off of the sliver feeding means as a result of a yarn breakage and the preferable stoppage of the friction rollers and before the actual piecing process, which includes a switching-on of the yarn withdrawal means and of the drives of the friction rollers and of the sliver feeding roller means, and wherein the following process steps are carried out in a predetermined time sequence:

a brief switching-on and switching-off of the sliver feeding means, a switching-off of the primary suction means and a switching-on of the auxiliary suction means, a switching-off of the auxiliary suction means and a switching-on of the primary suction means, an application of the yarn end to the wedge-shaped gap.

14. A process according claim 1, wherein after the switching-off of the sliver feeding means as a result of a yarn breakage and the preferable stoppage of the friction rollers and before the actual piecing process, which includes a switching-on of the yarn withdrawal means and a switching-on of the drives of the friction rollers and of the sliver feeding roller means, and therein the following process steps are carried out in a predetermined time sequence:

a brief switching-on and switching-off of the sliver feeding means,
an exposing of the wedge-shaped gap,
a cleaning of the friction rollers,
a covering of the wedge-shaped gap (using 122),
and an application of the yarn end to the wedge-shaped gap.

15. A process according to claim 4, wherein after the switching-off of the sliver feeding means as a result of a yarn breakage and the preferable stoppage of the friction rollers and before the actual piecing process, which includes a switching-on of the yarn withdrawal device and a switching-on of the drives of the friction rollers and of the sliver feeding roller means, and wherein the following process steps are carried out in a predetermined time sequence;

a switching-off of the primary suction means and switching-on of the auxiliary suction means,
a switching-off of the auxiliary suction means and switching-on of the primary suction means,
a brief switching-on and switching-off of the sliver feeding means,
another switching-off of the primary suction means and switching-on of the auxiliary suction means,
a switching-off of the auxiliary suction means and a switching-on of the primary suction means,
and an application of the yarn end to the wedge-shaped gap.

16. A process according to claim 1, wherein after the switching-off of the sliver feeding means as a result of a yarn breakage and the preferable stoppage of the friction rollers and before the actual piecing process, which includes a switching-on of the yarn withdrawal device and a switching-on of the drives of the friction rollers and of the sliver feeding roller means, and wherein the following process steps are carried out in a predetermined time sequence;

an exposing of the wedge-shaped gap,
a brief switching-on and switching-off of the sliver feeding means as well as a simultaneous cleaning of the friction rollers,
an application of the yarn end to the wedge-shaped gap,
and a covering of the wedge-shaped gap.

17. A process according to claim 1, wherein after the switching-off of the sliver feeding means as a result of a yarn breakage and the preferable stoppage of the friction rollers and before the actual piecing process, which includes a switching-on of the yarn withdrawal device and a switching-on of the drives of the friction rollers and of the sliver feeding roller means, and wherein the following process steps are carried out in a predetermined time sequence;

an exposing of the wedge-shaped gap,
a brief switching-on and switching-off of the sliver feeding means as well as a simultaneous cleaning of the friction rollers,
a covering of the wedge-shaped gap,
and an application of the yarn end to the wedge-shaped gap.

18. A process according to claim 4, wherein after the switching-off of the sliver feeding means as a result of a yarn breakage and the preferable stoppage of the friction rollers and before the actual piecing process, which includes a switching-on of the yarn withdrawal device and a switching-on of the drives of the friction rollers and of the sliver feeding roller means, and wherein the following process steps are carried out in a predetermined time sequence;

an exposing of the wedge-shaped gap and switching-off of the primary suction device,
a cleaning of the friction rollers (with nozzle 122),
a covering of the wedge-shaped gap,
a brief switching-on and switching-off of the sliver feeding means as well as a switching-on of the auxiliary suction means,
an application of the yarn end to the wedge-shaped gap,
and a switching-on of the primary suction means as well as a switching-off of the auxiliary suction means.

19. A process according to claim 4, wherein after the switching-off of the sliver feeding means as a result of a yarn breakage and the preferable stoppage of the friction rollers and before the actual piecing process, which includes a switching-on of the yarn withdrawal device and a switching-on of the drives of the friction rollers and of the sliver feeding roller means, and wherein the following process steps are carried out in a predetermined time sequence;

an exposing of the wedge-shaped gap,
a cleaning of the friction rollers,
an application of the yarn end to the wedge-shaped gap,
a covering of the wedge-shaped gap,
a switching-on of the primary suction means and switching-off of the auxiliary suction means,
a brief switching-on and switching-off of the sliver feeding means,
a switching-off of the primary suction means and switching-on of the auxiliary suction means,
and a switching-off of the auxiliary suction means and switching-on of the primary suction means.

20. A process according to claim 4, wherein after the switching-off of the sliver feeding means as a result of a yarn breakage and the preferable stoppage of the friction rollers and the preferable switching-off of the primary suction means and switching-on of the auxiliary suction means and before the actual piecing process, which includes a switching-on of the yarn withdrawal means and a switching-on of the drives of the friction rollers and of the sliver feeding roller means, the following process steps are carried out in a predetermined time sequence:

a switching-on of the primary suction device,
a brief switching-on and switching-off of the sliver feeding means,
a switching-off of the primary suction means,
an application of the yarn end to the wedge-shaped gap,
a switching-on of the primary suction means and a switching-off of the auxiliary suction means.

21. A process according to claim 4, wherein after the switching-off of the sliver feeding means as a result of a yarn breakage and the preferable stoppage of the friction rollers and before the actual piecing process, which includes a switching-on of the yarn withdrawal means and a switching-on of the drives of the friction rollers and of the sliver feeding roller means, and wherein the following process steps are carried out in a predetermined time sequence:

a switching-off of the primary suction means and switching-on of the auxiliary suction means,
an application of the yarn end to the wedge-shaped gap,
a switching-on of the primary suction means,
a brief switching-on and switching-off of the sliver feeding means,
a switching-off of the primary suction means,
a switching-on of the suction device and switching-off of the auxiliary suction means.

22. A process according to claim 4, wherein after the switching-off of the sliver feeding means as a result of a yarn breakage and the preferable stoppage of the friction rollers and before the actual piecing process, which inlcudes a switching-on of the yarn withdrawal means and a switching-on of the drives of the friction rollers and of the sliver feeding roller means, the following process steps are carried out in a predetermined time sequence:

a brief switching-on and switching-off of the sliver feeding means,
a switching-off of the primary suction means and switching-on of the auxiliary suction means,
an application of the yarn end to the wedge-shaped gap,
and a switching-on of the primary suction means and switching-off of the auxiliary suction means.

23. A process according to claim 1, wherein after the switching-off of the sliver feeding means as a result of a yarn breakage and the preferable stoppage of the friction rollers and before the actual piecing process, which includes a switching-on of the yarn withdrawal means and a switching-on of the drives of the friction rollers and of the sliver feeding roller means, the following process steps are carried out in a predetermined time sequence:

a brief switching-on and switching-off of the sliver feeding device,
an exposing of the wedge-shaped gap,
a cleaning of the friction rollers,
an application of the yarn end to the wedge-shaped gap,
and a covering of the wedge-shaped gap (FIG. 17).

24. A process according to claim 1, wherein after the switching-off of the sliver feeding device as a result of a yarn breakage and the preferable stoppage of the friction rollers and before the actual piecing process, which includes a switching-on of the yarn withdrawal means and a switching-on of the drives of the friction rollers and of the sliver feeding roller means, the following process steps are carried out in a predetermined time sequence:

a switching-off of the primary suction means and switching-on of the auxiliary suction means,
a brief switching-on and switching-off of the sliver feeding means,
an application of the yarn end to the wedge-shaped gap,
and a switching-on of the primary suction means and switching-off of the auxiliary suction means.

25. A process according to claim 4, wherein after the switching-off of the sliver feeding means as a result of a yarn breakage and the preferable stoppage of the friction rollers and before the actual piecing process, which includes a switching-on of the yarn withdrawal means and a switching-on of the drives of the friction rollers and of the sliver feeding roller means, the following process steps are carried out in a predetermined time sequence:

a switching-off of the primary suction means and switching-on of the auxiliary suction means,
a brief switching-on and switching-off of tne sliver feeding means,
an exposing of the wedge-shaped gap,
an application of the yarn end to the wedge-shaped gap,
a covering of the wedge-shaped gap,
a switching-on of the primary suction means and the switching-off of the auxiliary suction means.

26. A process according to claim 4, wherein after the switching-off of the sliver feeding means as a result of a yarn breakage and the preferable stoppage of the friction rollers and before the actual piecing process, which includes a switching-on of the yarn withdrawal means and a switching-on of the drives of the friction rollers and of the sliver feeding roller means, the following process steps are carried out in a predetermined time sequence:

an exposing of the wedge-shaped gap,
a switching-off of the primary suction means and switching-on of the auxiliary suction means,
a cleaning of the friction rollers,
a covering of the wedge-shaped gap,
a switching-on of the primary suction means and switching-off of the auxiliary suction means,
a brief switching-on and switching-off of the sliver feeding means,
a switching-off of the primary suction means and switching-on of the auxiliary suction means,
an exposing of the wedge-shaped gap,
an application of the yarn end to the wedge-shaped gap,
a covering of the wedge-shaped gap,
a switching-on of the primary suction means and a switching-off of the auxiliary suction means.

27. A process according to claim 1, wherein the yarn withdrawal and/or the feeding of the fibers and/or the drive of the friction rollers during the production of the piecings are temporarily carried out at speeds that are reduced with respect to the operational speed, the speeds being coordinated with one another in such a way that a yarn count is spun that corresponds to the yarn count spun at operational speeds.

28. A process according to claim 27, wherein the speeds are coordinated to accelerate to the operational speeds in such a way that also during the acceleration, the same yarn count is spun.

29. A process according to claim 1, wherein yarn monitoring means are provided to detect yarn breakage and initiate the process for piecing a yarn.

30. Open-end friction spinning apparatus comprising:

a plurality of open-end friction spinning units of the type having at least one spinning unit with:
a pair of friction rollers arranged adjacent to one another to form a wedge-shaped yarn forming gap,
friction roller driving means for driving the friction rollers in the same rotational direction during spinning operations,
fiber opening means for separating fibers to be supplied to the yarn forming gap, said fiber opening means including a drivable opening roller means, sliver feeding means for feeding sliver to the fiber opening means, said sliver feeding means including a drivable sliver feeding roller means, yarn withdrawal means for withdrawing formed yarn from the yearn forming gap, primary suction means for applying suction forces to the yarn forming gap, yarn winding means for winding the spun year non a spool, a servicing apparatus which is selectively movable to respective servicing positions adjacent respective ones of said spinning units, said servicing apparatus including piecing means for carrying out means including sliver feed roller activitating means for activating the sliver feed roller means for an indicated time period, and turning of the sliver feed roller means at a predetermined time period prior to the initiation of an actual piecing process, and fiber removing means for removing fibers opened up prior to initiation of the actual piecing process from the spinning unit.

31. An open-end friction spinning machine according to claim 30, wherein the piecing means for carrying out a piecing process are connected to an automatic sequencing system determining the sequence of operation of the individual means which also controls the time periods for the actuating of the sliver feeding device preceding the actual piecing process at an exactly defined time period.

32. An open-end friction spinning machine according to claim 30, wherein the servicing apparatus is equipped with an auxiliary drive that can be connected with the sliver feeding roller.

33. An open-end friction spinning machine according to claim 30, wherein each spinning unit is provided with primary suction control means for interrupting and/or throttling the effect of the primary suction means, said primary suction control means being able to be actuated by the servicing apparatus.

34. An open-end friction spinning machine according to claim 30, wherein each spinning unit is provided with means for interrupting the drives of the friction rollers.

35. An open-end friction spinning machine according to claim 30, wherein each spinning unit is provided with an auxiliary suction means aimed at the exterior shell surfaces of the rollers in the area of the wedge-shaped gap, said auxiliary suction means being able to be connected to a vacuum source by the servicing apparatus.

36. An open-end friction spinning machine according to claim 35, wherein the auxiliary suction means leads out into a fiber feeding channel, and wherein each spinning unit is provided with closing means for closing the fiber feeding channel behind the mouth of the auxiliary suction means, said closing means being able to be actuated by the servicing apparatus.

37. An open-end friction spinning machine according to claim 30, wherein each spinning unit (1) is provided with a removable cover for the wedge-shaped gap, and wherein the servicing apparatus is provided with means for removing and moving back the cover and cleaning means for cleaning that can be applied to the area of the exposed wedge-shaped gap.

38. An open-end friction spinning machine according to claim 30, wherein a fiber feeding channel of each spinning unit can be exposed at least partially, and wherein the servicing apparatus is provided with means for at least partially exposing the fiber feeding channel and with means that can be applied to the at least partially exposed fiber feeding channel and that receive the fibers transported in this fiber feeding channel.

39. A method for piecing a yarn at a spinning unit of an open-end friction spinning machine of the type wherein separated fibers are supplied to a yarn forming gap by means of a sliver feeding means and a sliver opening means which opens the sliver offered by the sliver feeding means, said method comprising feeding sliver to the sliver opening means and removing from the spinning unit fibers opened up during said feeding prior to the actual piecing process so that the sliver end offered to the sliver opening means has a predetermined constant configuration at the commencement of respective piecing operations.

40. A method according to claim 39, wherein said controlling comprises the sequential steps of;

activating the sliver feeding and opening means during a pre-piecing sliver combing operation, and stopping the sliver feeding means at a predetermined time period before restarting same to supply fibers for the piecing operation, whereby a sliver end of constant configuration is offered to the sliver opening means for each piecing operation.

41. A method according to claim 40, further comprising assuring that fibers obtained during the pre-piecing sliver combing operation are not present in the yarn forming gap at the time piecing commences.

42. Piecing apparatus for piecing a yarn at a spinning unit of an open-end friction spinning machine of the type wherein separated fibers are supplied to a yarn forming gap by means of a sliver feeding means and a sliver opening means which opens the sliver offered by the sliver feeding means, said apparatus including control means for controlling the sliver feeding means and sliver opening means and fiber removing means for withdrawing fibers removed from the sliver end from the spinning unit prior to actual piecing so that the sliver end offered to the sliver opening means has a predetermined constant configuration at the commencement of respective piecing operations.

43. Piecing apparatus according to claim 42, wherein said control means comprises means for effecting the sequential steps of:

activating the sliver feeding and opening means during a pre-piecing sliver combing operation, and stopping the sliver feeding means at a predetermined time period before restarting same to supply fibers for the piecing operation, whereby a sliver end of constant configuration is offered to the sliver opening means for each piecing operation.

44. Piecing apparatus according to claim 42, wherein said control means comprises means for assuring that fibers obtained during the pre-piecing sliver combing operation are not present in the yarn forming gap at the time piecing commences.

* * * * *